US007306389B2

(12) United States Patent
Wakat

(10) Patent No.: US 7,306,389 B2
(45) Date of Patent: Dec. 11, 2007

(54) PAINT CARTRIDGE EDGER AND SPREADER

(75) Inventor: George H Wakat, St. Paul Park, MN (US)

(73) Assignee: Master Stroke Tools, Inc., St. Paul Park, MN (US)

( * ) Notice: Subject to any disclaimer, the term of this patent is extended or adjusted under 35 U.S.C. 154(b) by 232 days.

(21) Appl. No.: 10/948,953

(22) Filed: Sep. 23, 2004

(65) Prior Publication Data

US 2005/0117959 A1 Jun. 2, 2005

Related U.S. Application Data

(60) Provisional application No. 60/505,498, filed on Sep. 23, 2003.

(51) Int. Cl.
*A45D 40/20* (2006.01)
*A47L 1/08* (2006.01)

(52) U.S. Cl. ..... 401/88; 401/136; 401/137; 401/139; 401/265

(58) Field of Classification Search ..... 401/136–140, 401/268, 270, 271, 265, 267
See application file for complete search history.

(56) References Cited

U.S. PATENT DOCUMENTS

| | | | | |
|---|---|---|---|---|
| 1,598,742 | A | | 9/1926 | Parker |
| 2,711,098 | A | | 6/1955 | Ames |
| 2,809,513 | A | | 10/1957 | Ames |
| 2,824,326 | A | | 2/1958 | Ames |
| 2,824,442 | A | | 2/1958 | Ames |
| 3,020,579 | A | | 2/1962 | O'Connor |
| 3,070,824 | A | | 1/1963 | Martin |
| 3,070,825 | A | | 1/1963 | Martin |
| 3,116,511 | A | | 1/1964 | Hoveland |
| 3,224,025 | A | * | 12/1965 | Altrock ..... 15/119.2 |
| 3,690,779 | A | * | 9/1972 | Ellis ..... 401/287 |
| 3,713,744 | A | | 1/1973 | Sims |
| 3,737,187 | A | | 6/1973 | Pryor |
| 3,776,645 | A | * | 12/1973 | Walker ..... 401/188 R |
| 3,918,820 | A | | 11/1975 | Kim |
| 4,219,899 | A | | 9/1980 | Zurawin et al. |
| 4,566,816 | A | | 1/1986 | Janssen |
| 4,611,941 | A | | 9/1986 | Karliner et al. |
| 4,898,295 | A | | 2/1990 | Kim |
| 4,971,471 | A | | 11/1990 | Sloan |
| 4,977,724 | A | | 12/1990 | Kim |
| 5,000,602 | A | | 3/1991 | Kim |

(Continued)

FOREIGN PATENT DOCUMENTS

| | | |
|---|---|---|
| DE | 881 035 | 5/1953 |

(Continued)

*Primary Examiner*—Khoa D. Huynh

(57) ABSTRACT

The spreader has a housing for receiving a first receptacle and a second receptacle. The first receptacle is a cartridge of fluid, such as paint. The second receptacle is a manifold having a secondary reservoir, a meter, and a spreading material. Paint is transferred from the first receptacle to the second receptacle via a main conduit, with a pair of pistons acting upon the main conduit between a pair of one directional check valves. The pair of pistons may be replaced by a button pump having two one way valves. The manifold is slideably engaged to the housing such that manifolds having different conduit arrangements, larger conduits, different meters, different spreading materials, and different end portions, may be used.

12 Claims, 26 Drawing Sheets

U.S. PATENT DOCUMENTS

| | | | | |
|---|---|---|---|---|
| 5,007,753 | A | 4/1991 | England, Jr. | |
| 5,016,755 | A | 5/1991 | Kim | |
| 5,146,646 | A | 9/1992 | Langford et al. | |
| 5,445,195 | A | 8/1995 | Kim | |
| 5,454,656 | A | 10/1995 | Rowe | |
| 5,622,283 | A | 4/1997 | Morrison | |
| 5,683,013 | A | 11/1997 | Morrison | |
| 5,845,812 | A | 12/1998 | Morrison | |
| 5,855,715 | A | 1/1999 | Langford et al. | |
| 5,866,206 | A | 2/1999 | Jennings-Tolchiner | |
| D416,112 | S | 11/1999 | Holliday et al. | |
| 6,036,391 | A | 3/2000 | Holliday et al. | |
| 6,146,040 | A | 11/2000 | Dunn et al. | |
| 6,257,969 | B1 * | 7/2001 | Bosten et al. | 451/356 |
| 6,493,899 | B1 | 12/2002 | Hintz et al. | |
| 6,705,792 | B2 * | 3/2004 | Smith | 401/137 |

FOREIGN PATENT DOCUMENTS

| | | |
|---|---|---|
| FR | 1090590 | 3/1955 |

* cited by examiner

PAINT CARTRIDGE EDGER AND SPREADER

This application claims the benefit under 35 U.S.C. 119(e) of U.S. Provisional Patent Application No. 60/505,498 filed Sep. 23, 2003, which is hereby incorporated by reference in its entirety into this application. This application further incorporates by reference in its entirety U.S. patent application Ser. No. 10/946,903 filed on Sep. 21, 2004 under Express Mail number ED-158-736-009-US, entitled Slideable Nonrolling Spreader, naming George H. Wakat as inventor, and having attorney docket number GHW-SNS-1.

FIELD OF THE INVENTION

The present invention relates to an apparatus having a removable cartridge with a fluid or coating therein and a removable second piece having a meter and spreading material that meters and spreads the fluid or coating upon a surface.

BACKGROUND OF THE INVENTION

A paint brush unloads paint relatively quickly where the end of the paint brush is not flagged. Flagged paint brushes are extremely expensive. A paint brush, even a flagged paint brush, leaves a trail because a paint brush is rectangular and paints like a boat running rearwardly in water or like a plow. Also, a paint brush has a relatively great amount of drag. A paint brush, even a flagged paint brush, leaves linear streaks (or linear bumps in the nature of ridges). Loading a paint brush is an art, known by few and practiced by even less. Loading a paint brush involves setting the paint up on the bristles above the flagging (or split ends or catches) without wiping the bristles on the rim of the can. Wiping the bristles on the side of the can to remove "excess" paint, practiced by most homeowners, is actually an unloading. In other words, the homeowner loads and unloads and then attempts to paint.

A paint roller leaves a trail on both sides and makes an orange peel effect. The high part of the bump does not dry well because it is too thick at such point. As one rolls, the roller lifts the paint from the surface because of the surface tension of the fiber, leaving a series of bumps.

A paint pad includes a foam backing and a layer of bristles glued onto the foam. The foam has some resiliency to permit a give to the layer of bristles as the layer of bristles run over the surface that is being painted. The foam further isolates the layer of bristles from the handle grasped by the user. The foam does not hold paint. The bristles unload paint instantly.

Paint may be sprayed with air, without air (airless), with air assist (air assist airless). Such painting produces the high/low (orange peel) effect. Airless is high volume, high pressure so one cannot do a fine finish. A wall has surface tension of its own. The surface tension is created by dirt and dust and residue on the wall. This surface tension has to be overcome for the sprayed paint to coat and stick to the wall. Further, the transfer efficiency of an air spray gun is about 25% to about 45%, of an airless spray gun is about 60%, of an air assist airless is about 75%, because with these methods much of the paint bounces off. With spray painting, everything in the room to be painted must be covered. With spraying, the end effect is a surface having a plurality of miniature nails sticking out from the surface. Such a rough surface immediately begins to collect dust and dirt. With spraying, a mask is best used.

Electrostatic (automotive) painting does not produce the high/low effect. Electrostatic painting leaves an almost perfectly smooth finish. However, one cannot ground sheetrock or wood or glass or plastic (without first providing an electrostatic coating onto the substrate).

SUMMARY OF THE INVENTION

A paradigm is a set of assumptions, concepts, values, and practices that constitutes a way of viewing reality for the community that shares them, especially in an intellectual discipline.

The present invention provides a finish that is almost exactly like an electrostatic finish. The finish provided by the apparatus of the present invention is flat.

The present invention is a new paradigm. This paradigm spreads paint:

Evenly and smoothly. The present invention unloads paint evenly and spreads paint evenly and smoothly due at least in part to the high surface tension of the spreading material. The high surface tension is provided by a very fine network of fibers that run in all directions. In contrast, a brush has bristles that line up parallel, causing parallel highs and lows. A roller may have a network, but this network pulls paint away from a wall as it rolls, causing the orange peel (high/low profile) effect. With a high/low effect, the peak of the high or hump or bump may sag under the influence of gravity, causing a run. Paint pads cause highs and lows because the paint pad dumps immediately. With the present invention, paint coverage is maximized with a minimum amount of paint because there are no highs and no lows.

Fast. The present invention spreads paint quickly because the cartridge or bag has a relatively great capacity, because there is no dipping like with brushes and rollers, because there is no going back for more paint like with brushes and rollers and pads, because one pass is all one needs, because there are no trails to smooth out or re-spread, and because there are no ridges or holidays or misses to recover.

Efficiently. Transfer efficiency is between about 98% and 99.9%. There is no dripping and no loss of paint. The only paint that is left behind is the residual left on the inside wall of the receptacle or bag, the residual in the main conduit, and the residual in the reticulated foam, and the residual in the spreading material.

With no masking. The present invention includes an edger and there is no reason to cover the woodwork or anything in the room to be painted because there is no splatter or dripping such as with brushing, rolling and spraying.

By a direct fixing to the substrate itself, not an indirect fixing to dirt and dust and residue on the substrate. By manually pushing the spreading material onto the wall, with one's hand relatively close to the wall, with a relatively wide surface of spreading material (about three inches), one breaks through the dirt and dust, which is mixed up with the fluid or coating or paint, and applies the fluid or coating or paint directly to the substrate itself. In contrast, a brush has a spreading surface about one-half inch thick and one's hand is relatively far from the wall and the brush bends to minimize the force that one applies to the wall.

By a fixing with a minimum amount of flow and wetting agents. Flow and wetting agents minimize beading and permit a spreading of the paint. However, flow agents are undesirable in that flow agents cut down on adhesion properties. Another side effect is that the bond between adjacent molecules is lessened such that the skin of the paint is not very strong. The manual energy supplied by the user of the present invention provides the flow energy to make the paint spread out. While a paint brush user supplies manual energy, such is minimal because the bristles bend and there is only one-half inch of spreading bristles. While a paint roller user supplies manual energy, such is like a rock skipping across the water: only one-eighth of an inch of the roller is making contact with the wall and such one-eighth of an inch is not sliding (which is preferable) but is instead rolling like a wheel.

Another advantage of the present invention is that no paint makes contact with the interior or exterior of the housing. For example, three common fluids are interior stain, interior varnish and interior wall paint. Woodwork is stained and varnished. Walls are painted. With the present invention, to change from stain to varnish to paint, merely a cartridge or bag is replaced. A new manifold having a different spreading material is slid on.

Another advantage is that the capacity of the cartridge or housing for the cartridge is independent of the size of the manifold having the spreading material.

Another advantage is that, since the paint is in a bag that by nature is flexible, the bag may be kneaded, thereby mixing the paint.

Another advantage is that, instead of washing out the housing, a plastic wrap or hood or cover may be placed around the manifold, cutting off all air and leaving the spreading material ready to paint in the morning. No paint is wasted by washing.

DESCRIPTION OF THE PREFERRED EMBODIMENT

Figure 1A:
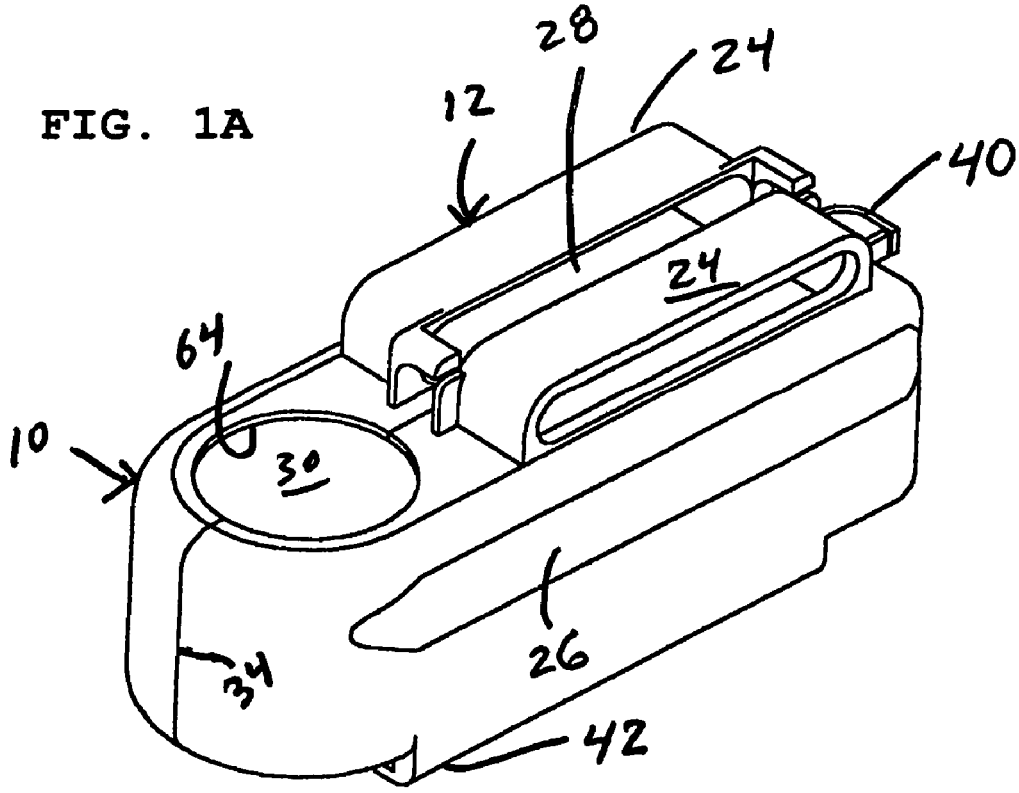
FIG. 1A is a small perspective view of the housing of the present invention that houses the paint cartridge.

The present invention or apparatus 10 includes a housing 12, a pair of pistons 14, a cartridge 16 having a receptacle or bag 18, a receptacle or manifold 20, and a main conduit 22.

Figure 2:
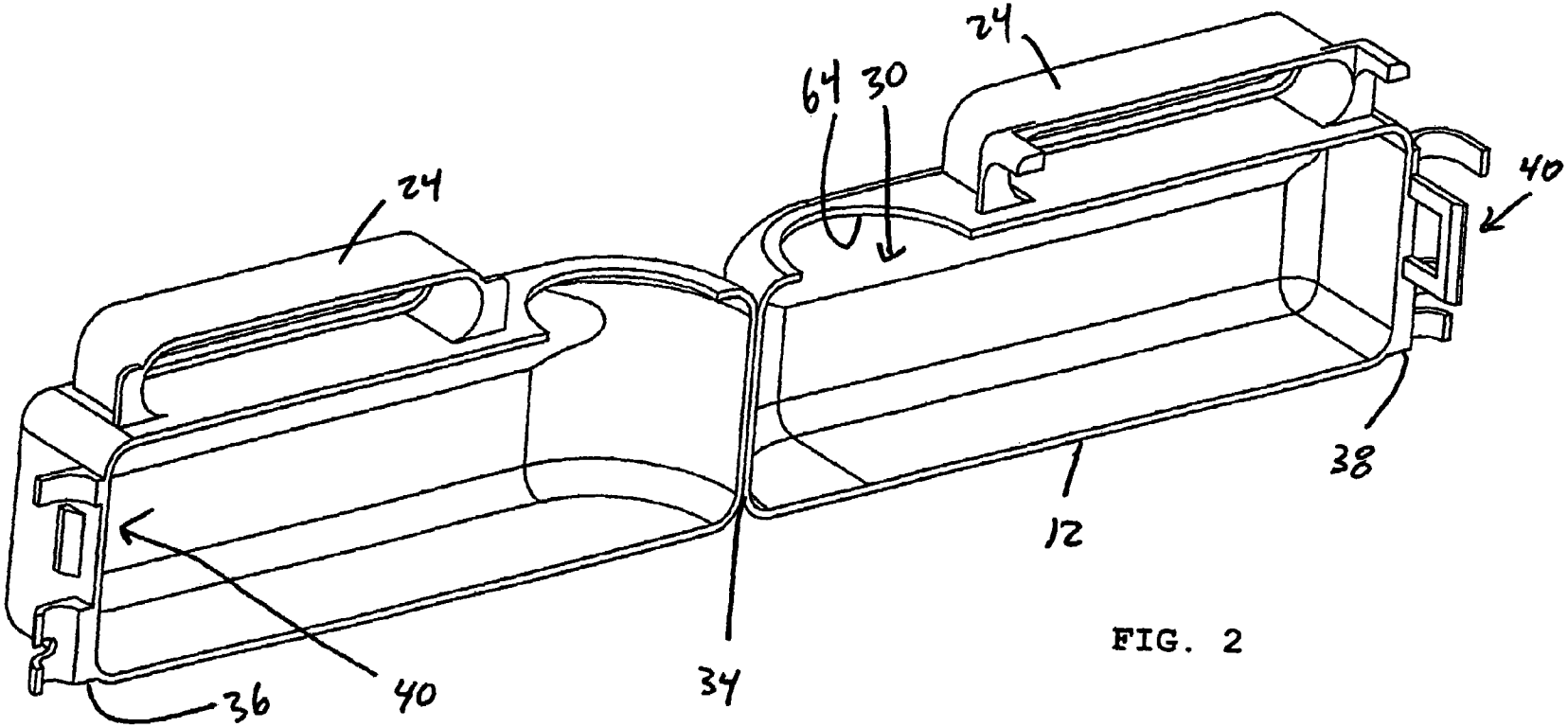
FIG. 2 is a detailed perspective view of the housing of FIG. 1A swung open via a living hinge to a loading position for loading the paint cartridge of FIG. 1C.
Figure 3A:
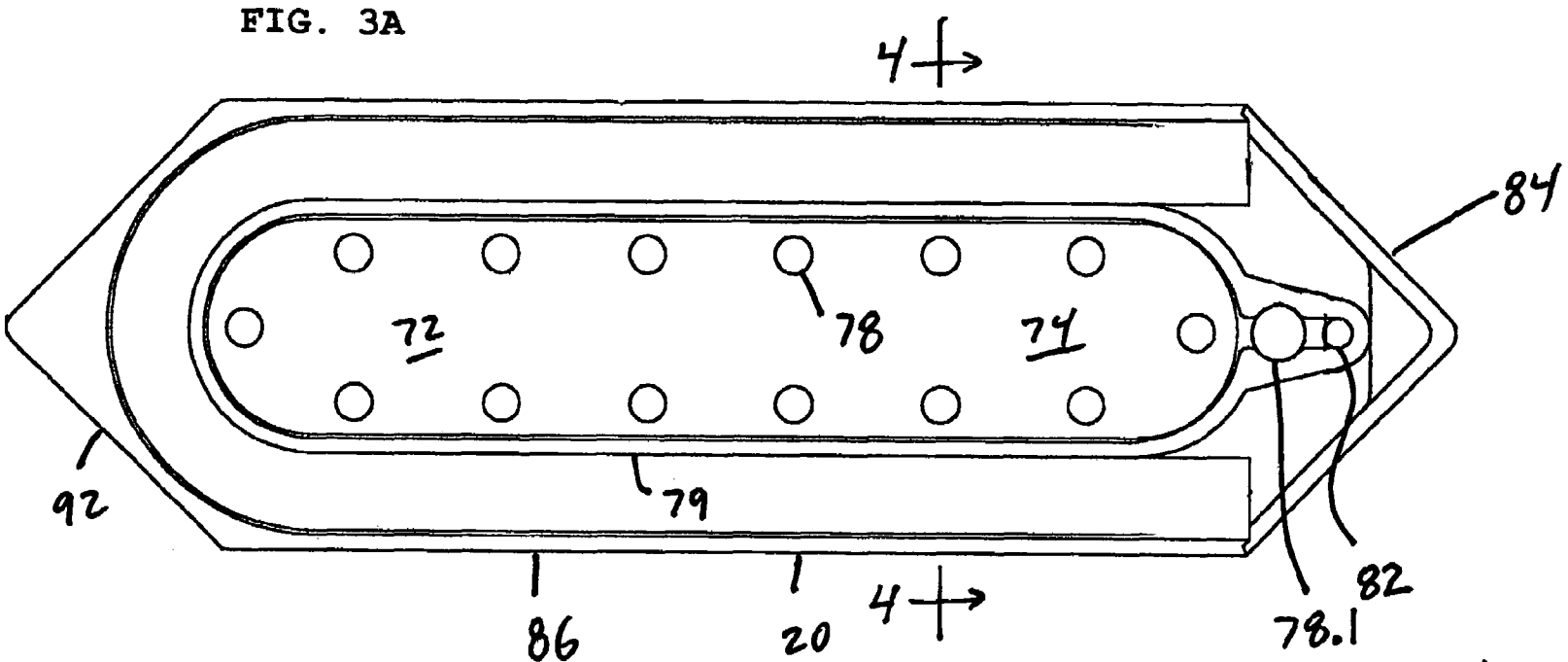
FIG. 3A is a detailed top view of the main body of the manifold of FIG. 1E.
Figure 3B:
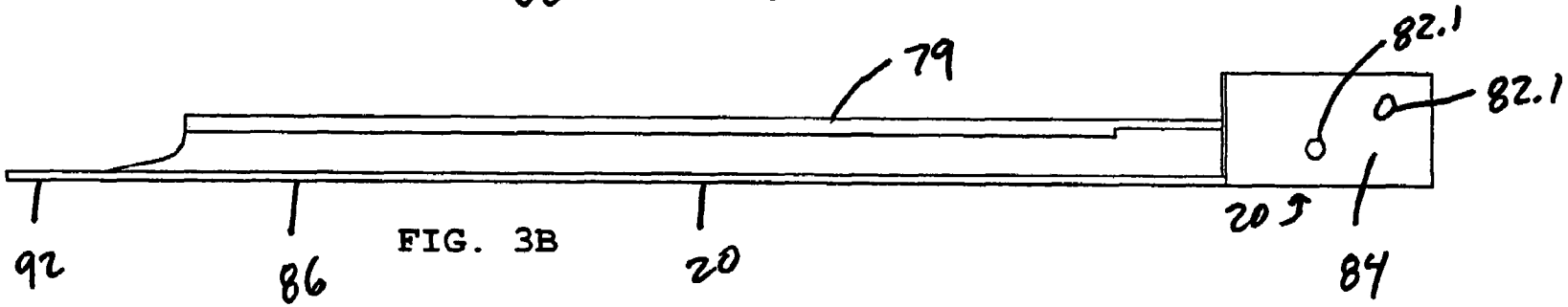
FIG. 3B is a detailed side view of the main body of the manifold of FIG. 3A.
Figure 4:
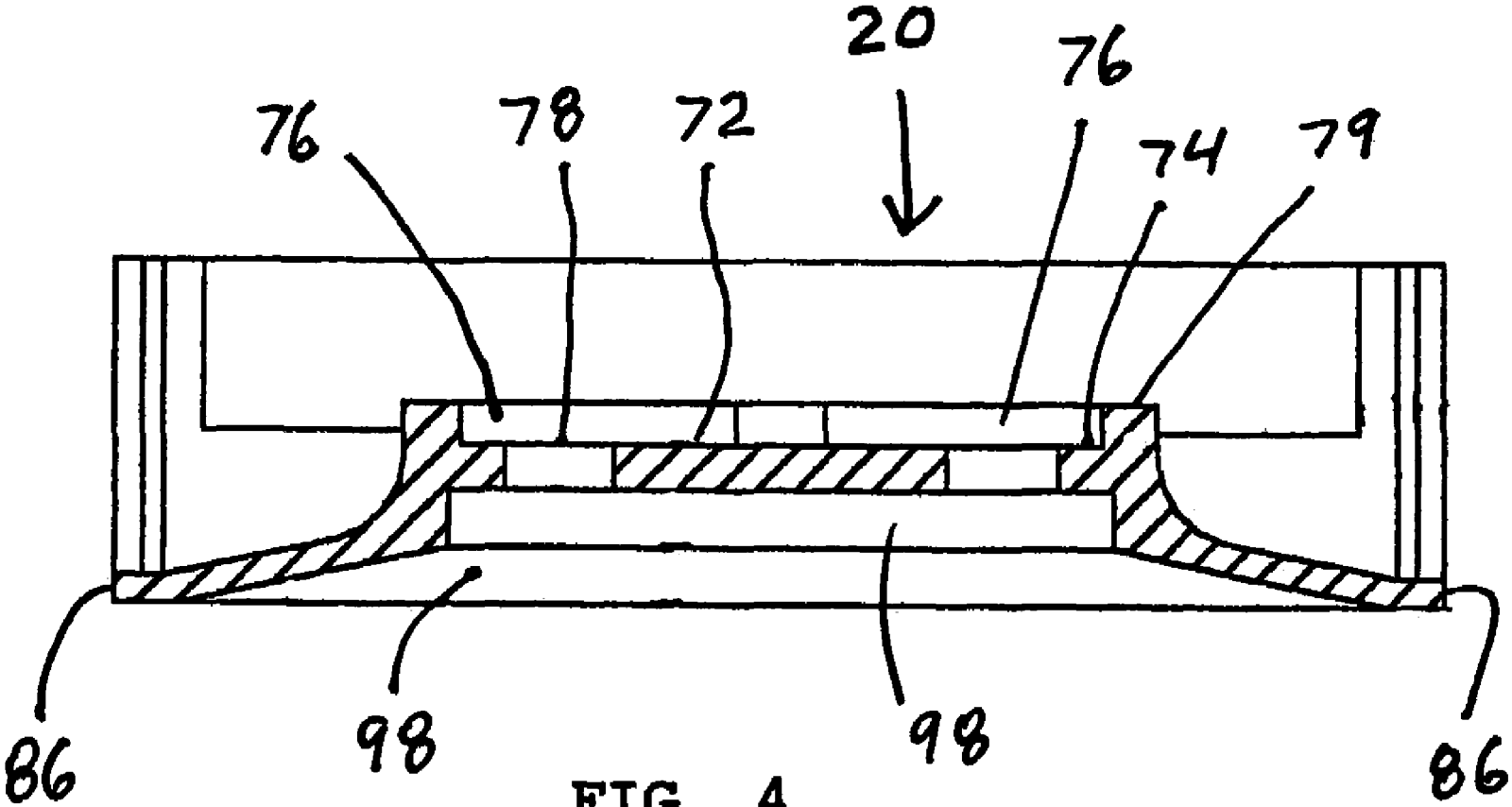
FIG. 4 is a section view at lines 4-4 of FIG. 3A.
Figure 5:
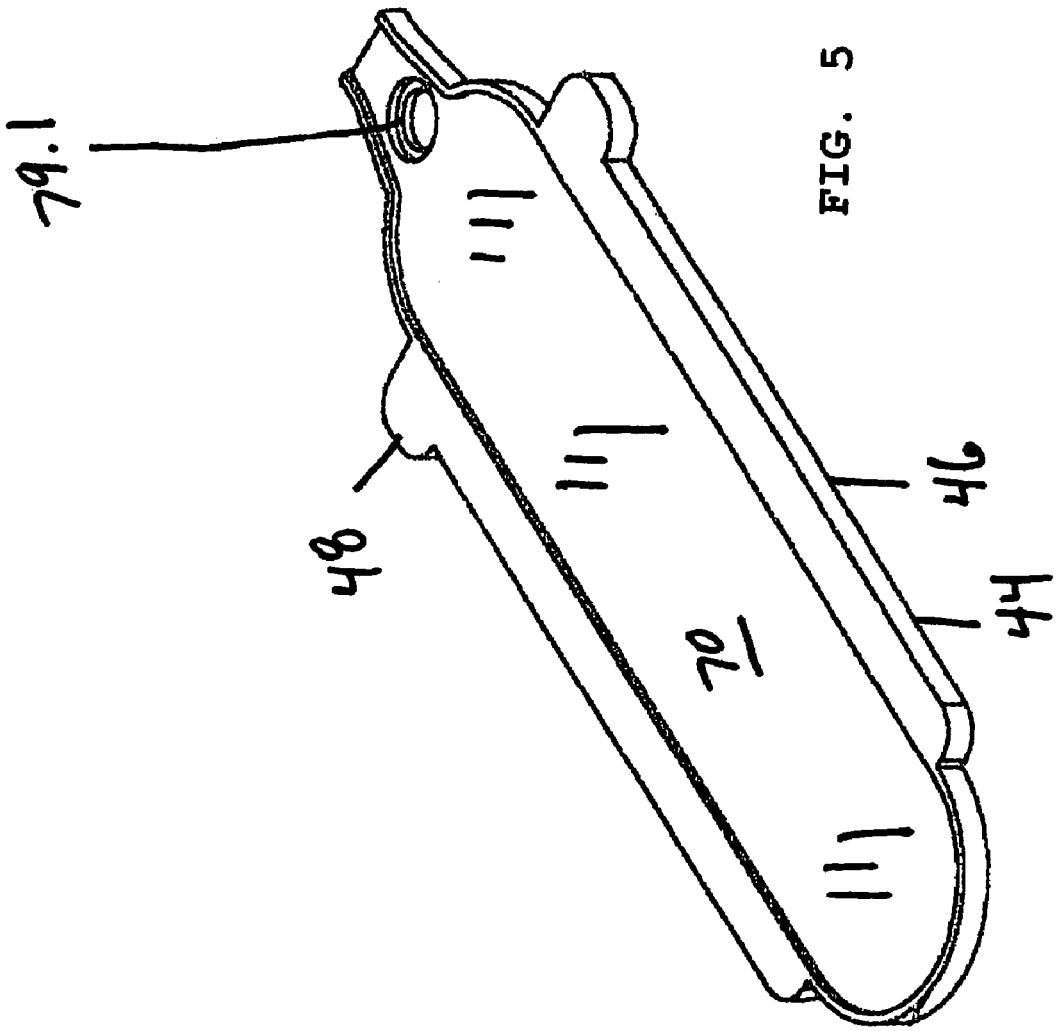
FIG. 5 is a detail perspective view of the top of the manifold of FIG. 1D.
Figure 6:
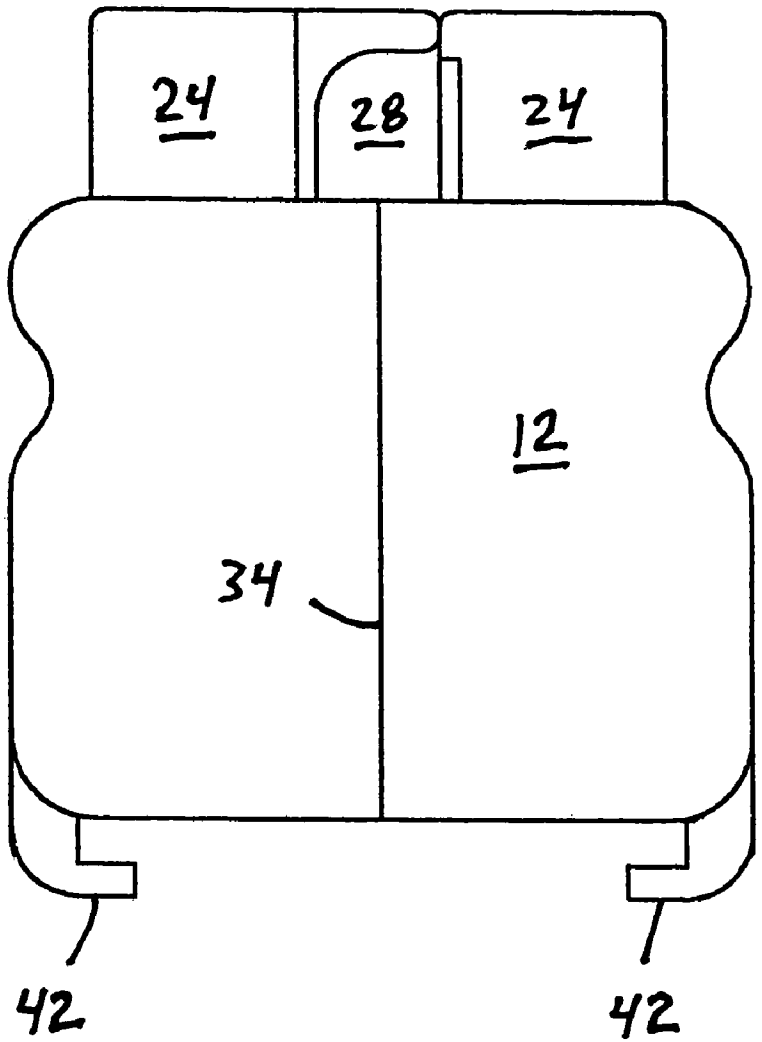
FIG. 6 is an end view of the housing of FIG. 1 and shows the living hinge and tracks or channels for engaging the manifold via the sides of the top of the manifold.

FIG. 1A shows the housing 12. Housing 12 houses the cartridge 16 and is protection for the bag 18. Housing 12 includes a pair of piston receptacles 24, one for each of the pistons 14. Housing 12 further includes an indentation or detent for mounting mechanical fingers for automated operation or operation at a distance of pistons 14. Between the piston receptacles 24 is a channel 28 for reception of the main conduit 22. Housing 12 further includes an opening 30 for permitting the extension therethrough or engagement thereof of an upper end 32 of the cartridge 16. Housing 12 may be swung open via a living hinge 34, as shown in FIG. 2. Ends 36, 38 of housing 12 have connections for releasably locking the housing 12. Cartridge 16 is taken in and out of housing 12 by swinging open the housing 12 via the living hinge 12 and unlocking and locking the connections. The connections 40 or other end features further can be shaped to retain the main conduit 22 adjacent to where the main conduit 22 is engaged to the manifold 20. On the underside of housing 12 is a pair of channels or tracks 42 for engaging flat sides 44 of a top 46 of manifold 20. The top 46 of manifold 20 includes a pair of nubs 48 for engaging a concave detent in the tracks 42 such that the manifold 20 can be locked at a desired position relative to the housing 12. Housing 12 as a whole, or more specifically the pair of pistons 14 when in the receptacles 24, is a handle for apparatus 10.

Figure 1B:
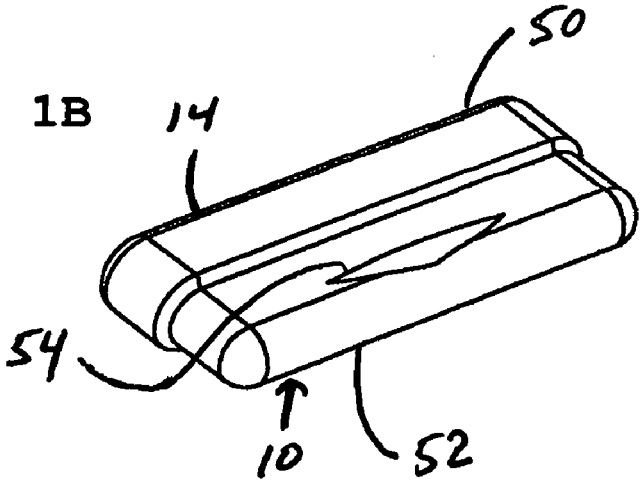
FIG. 1B is a small perspective view of a piston for being engaged with the housing of FIG. 1A and for pumping paint from the paint cartridge housed by the housing.
Figure 7:
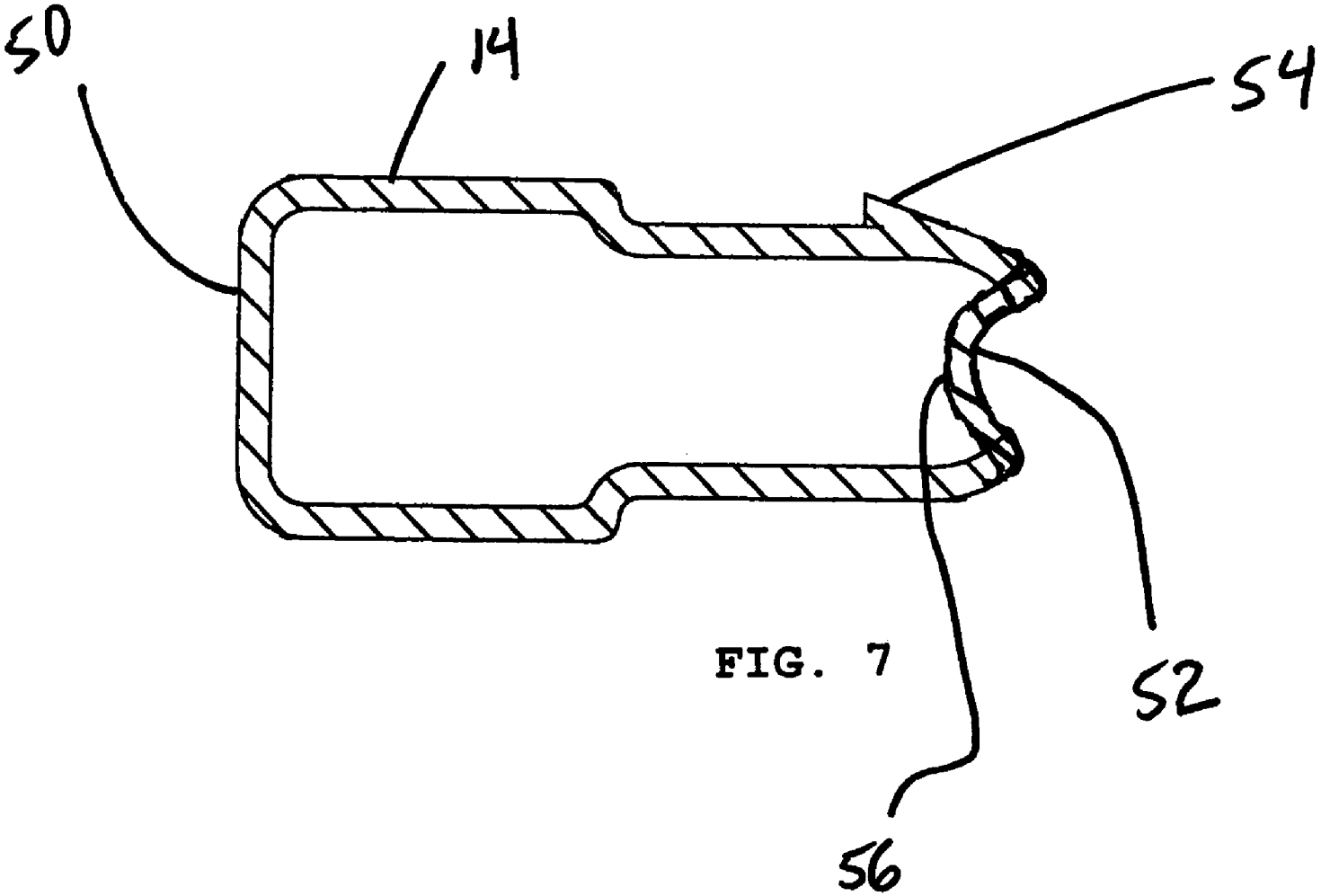
FIG. 7 is a section view through the piston of FIG. 1B.
Figure 8:
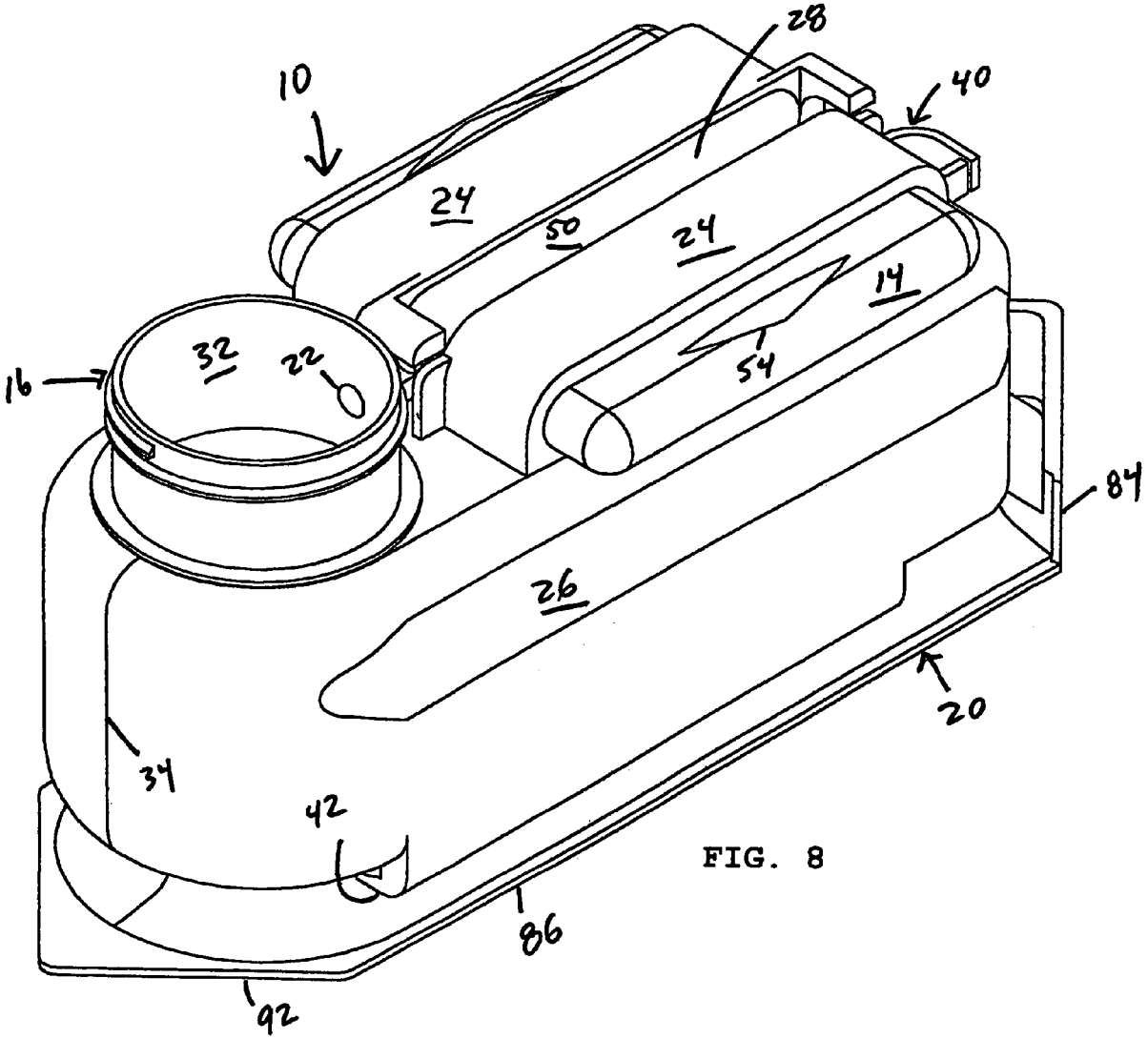
FIG. 8 is a detailed perspective view of the housing of FIG. 1A having engaged the pistons of FIG. 1B, the paint cartridge of FIG. 1C, the manifold of FIGS. 1D and 1E, and the main conduit of FIG. 1F.
Figure 9:
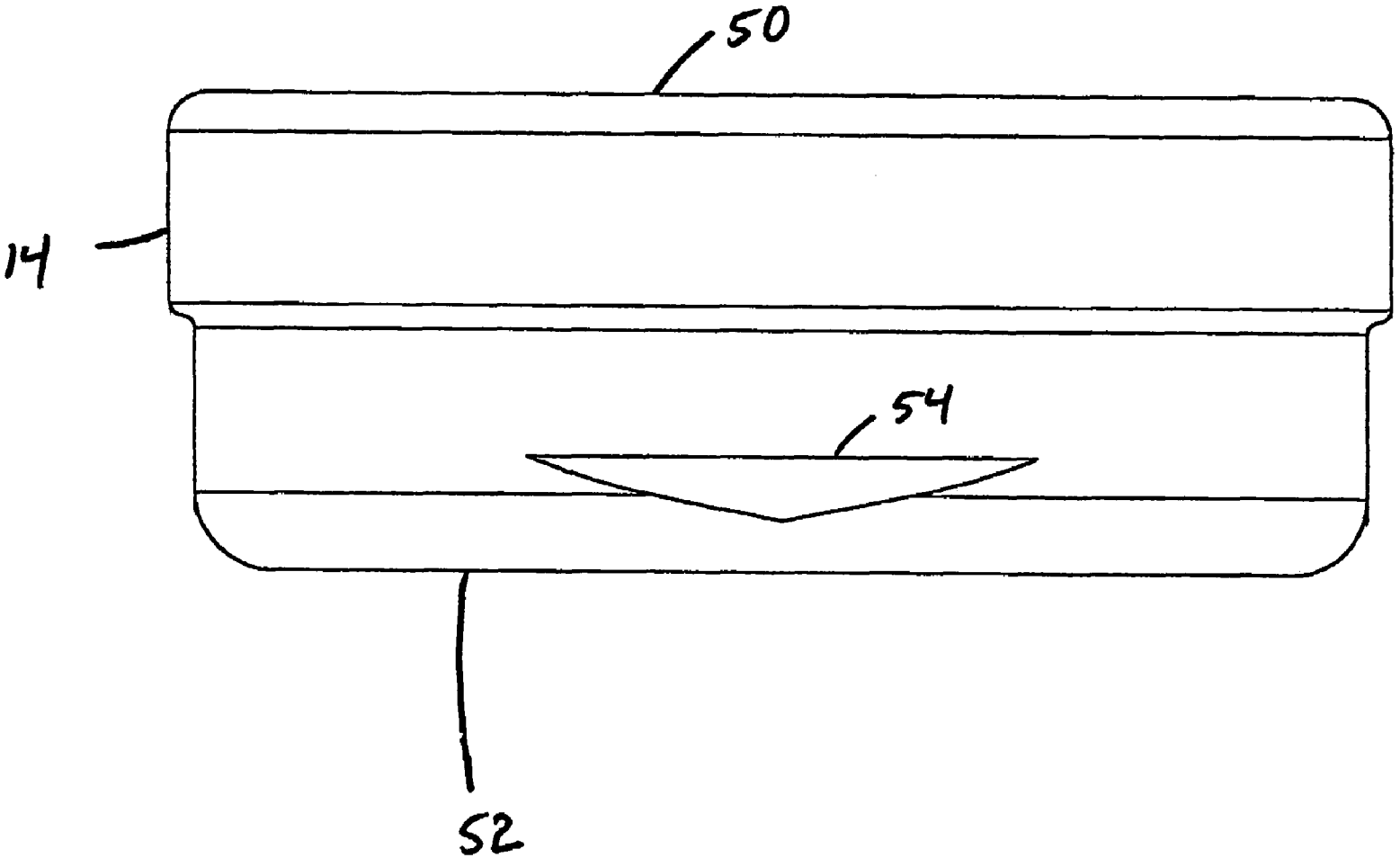
FIG. 9 is a top view of the piston of FIG. 1B.

As shown in FIG. 1B, piston 14 is hollow and relatively light in weight. Piston 14 includes a sufficient width so as to permit four adult sized fingers along its width, with a thumb operating the opposing piston 14 for a maximum amount of squeezing power. Piston 14 includes a generally flat pressing face 50 that makes contact with and works upon the main resilient conduit 22. As the pistons 14 are squeezed, the resiliency of the conduit 22 pushes out the pistons 14 as the user releases pressure upon the pistons 14. It should be noted that it is preferable that a gripping surface 52 of piston 14 is nondirectional such that either end of manifold 20 may be used to paint. Piston 14 includes a lock or latch 54 to keep the piston 14 in piston receptacle 24. It should be noted that gripping surface 52 may include a concave channel 56 running the length of the generally vertically extending face of gripping surface 52. Such a concave channel 56, as shown in FIG. 7, may give a more solid grip.

Main conduit 22 runs from receptacle or cartridge 16 to receptacle or manifold 20. Main conduit 22 includes a first one way directional check valve 58 and a second one way directional check valve 60. Each of valves 58, 60 permits fluid to run in the direction from cartridge 16 to manifold 20. Each of valves 58, 60 prevents fluid from running in the opposite direction. When piston faces 50 press upon the main conduit 22 fluid (whether such fluid is air or paint or another coating material) in the pressed upon portion of the main conduit 22 and fluid downstream therefrom is pushed through second valve 60 to the manifold 20. This is a one to one pressure ratio. Upon release or partial release by the user, the resiliency of the main conduit 22 pushes the pistons 14 out and creates a partial vacuum in the main conduit section between the check valves 58, 60, thereby drawing fluid from cartridge 16 into the section of the main conduit 22 between the check valves 58 and 60. Then, a squeezing action on the pistons 14 again squeezes main conduit 22, forcing fluid through second check valve 60 and into manifold 20. Soon, if cartridge 16 had any air, such air is evacuated from cartridge 16 and bag 18 and henceforth, cartridge 16 is free from air (or is airless). Main conduit 22 includes quick connects at either end, with one quick connect engaging the cartridge 16 and with the other quick connect engaging the manifold 20.

Figure 1C:
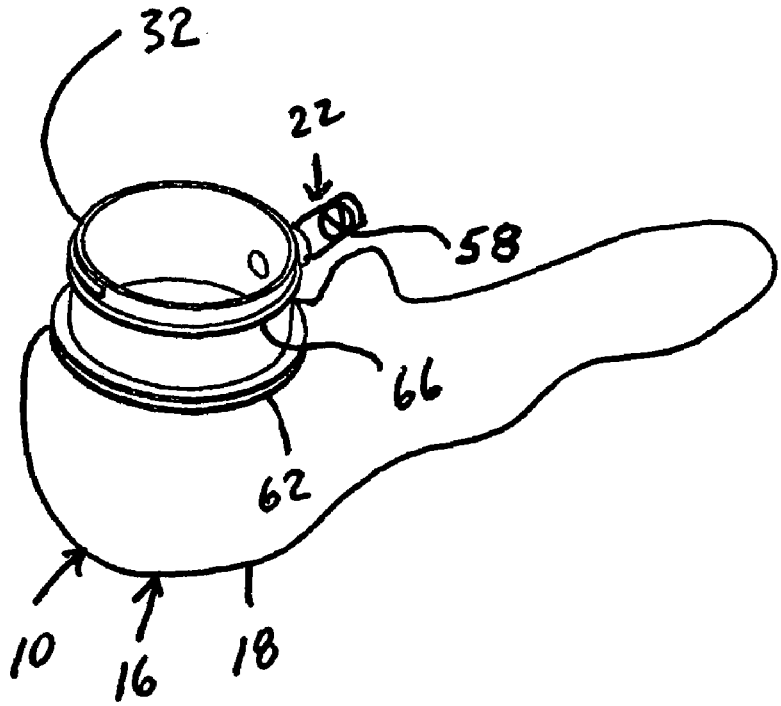
FIG. 1C is a small perspective view of the paint cartridge to be housed in the housing of FIG. 1A.
Figure 1D:
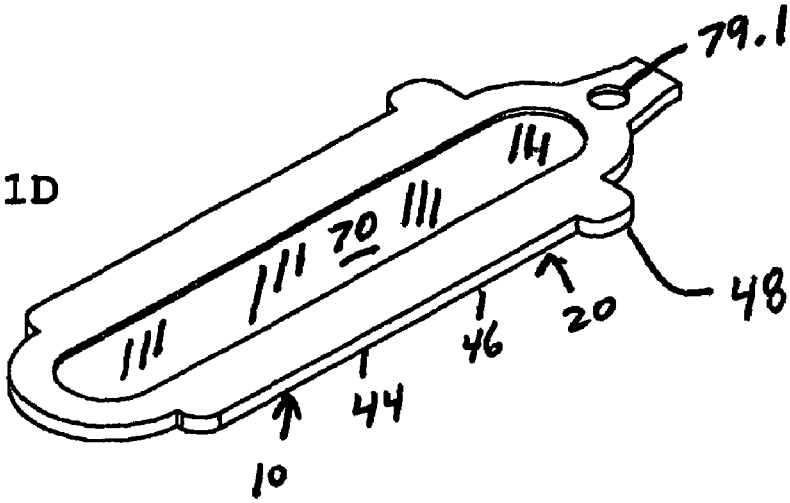
FIG. 1D is a small perspective view of the top of a manifold, where the top includes flat sides for engaging tracks or channels on the underside of the housing and where the top further includes nubs for locking into such tracks or channels.
Figure 1E:
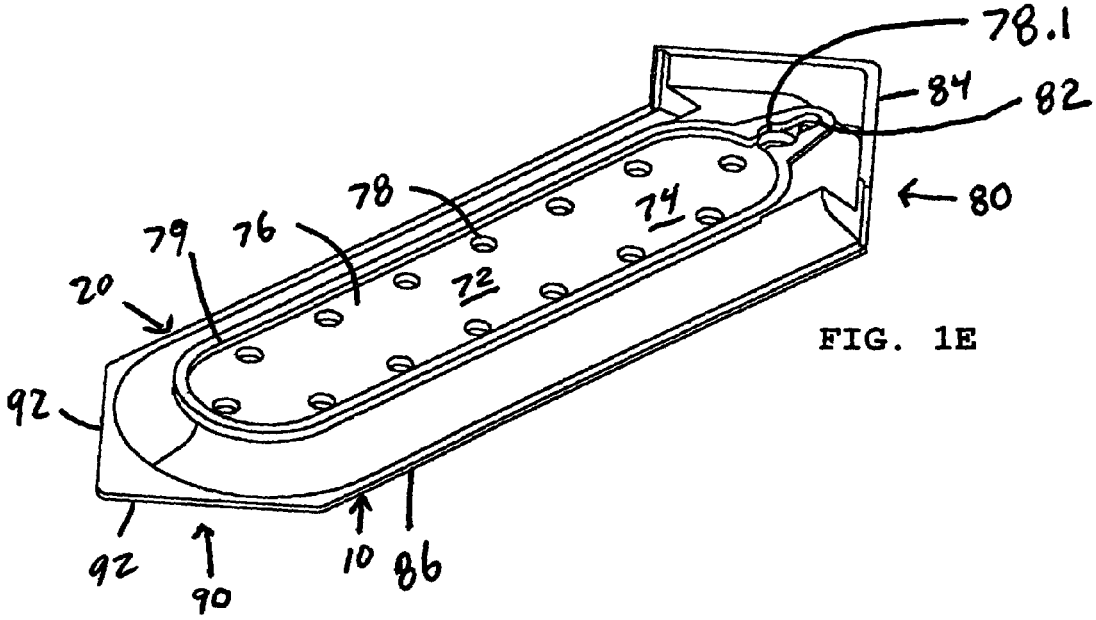
FIG. 1E is a small perspective view of a main body of a manifold for distributing paint, on which the top of FIG. 1D is engaged, and which supports a spreading material that ultimately spreads the paint on a surface.
Figure 1F:
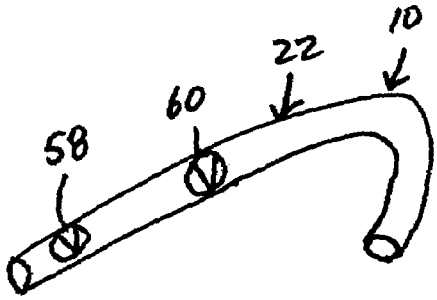
FIG. 1F is a small perspective of the main conduit that conveys paint from the paint cartridge of FIG. 1C to the manifold of FIG. 1E.

As shown in FIG. 1C, cartridge 16 includes upper molded plastic end 32. End 32 includes a portion of the quick connect to the main conduit 22. End 32 includes an annular or endless engagement channel 62 for receiving an annular edge 64 of housing 12. End 32 further includes a thread or threads 66 for engaging a sealing cap. End 32 forms a port or inlet through which paint or fluid is transferred into bag 18. The sealing cap may have a quick connect for engaging a tube running from a backpack that may contain a fluid reservoir. Or such tube may run from a pumping apparatus or pressurized supply. End 32 may if desired include check valve 58 therein. Bag 18 is preferably high density polyethylene. Bag 18 resists most solvents. Bag 18 is highly impermeable to air transfer. Bag 18 is flexible such that bag 18 can be kneaded. Bag 18 may be somewhat elastomeric to increase resistance to being pierced. Bag 20 can hold preferably between about 5 ounces and about 100 ounces, more preferably between about 10 ounces and about 80 ounces, and most preferably between about 20 ounces and about 64 ounces.

Top 46 of manifold 20 includes a lowered portion 70 that confronts and abuts a middle portion 72 of a platform 74 such that an endless channel 76 is formed over holes 78. Manifold 20 includes an inlet 78.1 to which one end of main conduit 22 is engaged via a quick connect (or a friction fit through a silicone gasket). From inlet 78.1, paint runs into channel 76 and to and through holes 78 to a secondary reservoir which is preferably reticulated foam. Top 46 is sealed to ridges 79 running about the holes 78 of the main body of the manifold 20. Top 46 includes an opening 79.1 for an end of main conduit 22. Opening 79.1 is aligned with inlet 78.1.

Manifold 20 includes a corner spreader 80. Paint may be supplied to corner spreader 80 independently via a valve engaged in port 82. Such a valve may be shut off when the spreader 10 is not in use to prevent an overflow or drippage. Corner spreader 80 includes a pair of relatively wide faces 84 for painting adjacent walls or the underlip of siding at the same time that the face of the siding is being painted. The faces 84 are set at ninety degrees to reach fully into a corner to be painted. Each of faces 84 meets a side 86 of manifold 20 at a forty-five degree angle so that no trails or ridges remain as the apparatus 10 is slid sideways such that edge 86 is disposed perpendicular to the sliding motion. Such is like a bow of a boat slicing through water leaving no wake. Port 82 communicates with one or more ports 82.1 in faces 84 to convey fluid to spreader material on faces 84.

Manifold 20 includes an edger 90 for cutting into woodwork. No wheels on such edger 90 are required. Edger 90 includes a pair of relatively narrow faces or edges 92. Edges 92 form a forty-five degree angle with side 86 of manifold 20 and act like a front of a sled such that no edge or side of manifold 20 catches upon the surface that the manifold 20 is riding against. It should be noted that a ninety degree angle between edge 92 and edge 86 would create chatter and is not preferred. The ninety degree relationship between edges 92 is preferred to permit the user to get into a ninety degree corner.

Figure 16A:
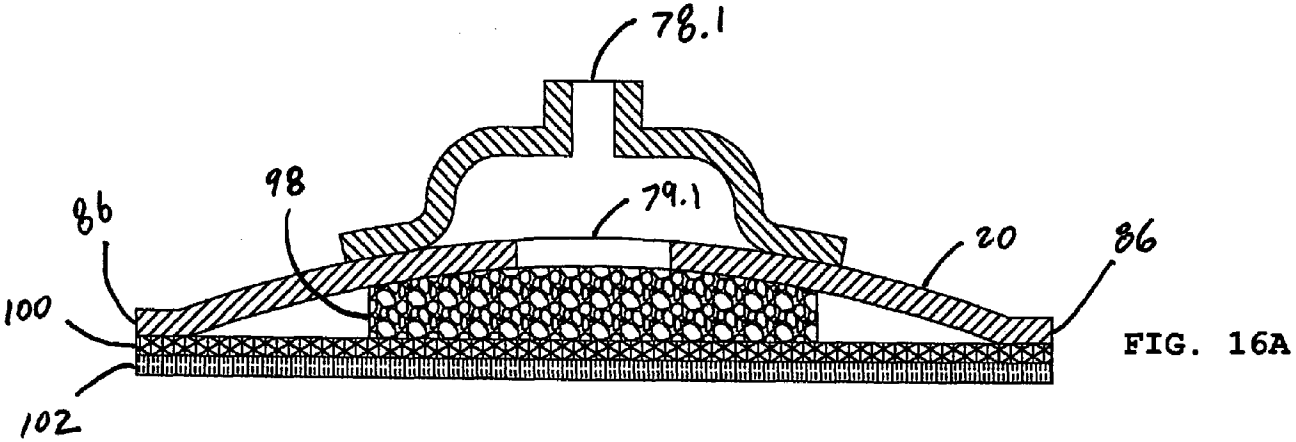
FIG. 16A is a diagrammatic section view through a front portion of the main body of the manifold of FIG. 10.
Figure 16B:
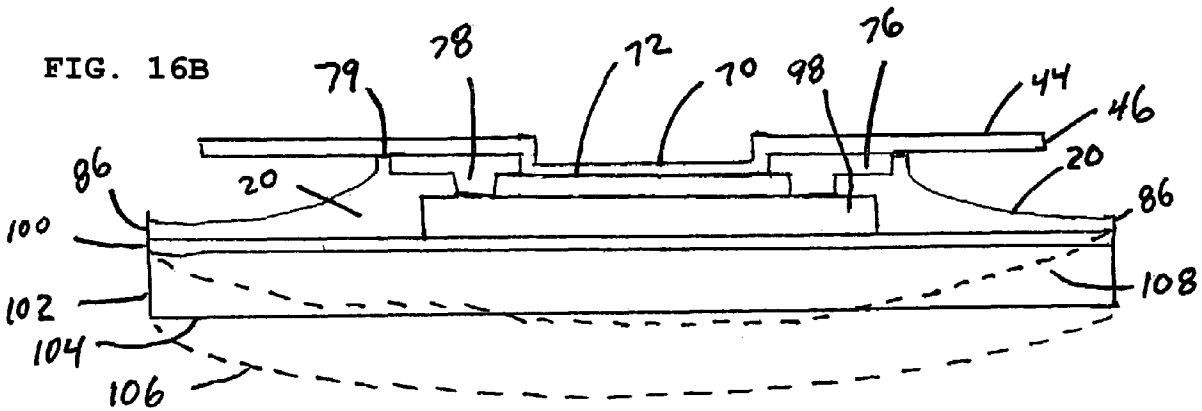
FIG. 16B is a diagrammatic section view through a generally middle portion of the manifold of FIG. 10 having the manifold top of FIG. 11 engaged thereon.

Manifold 20, as shown in FIGS. 16A and 16B further includes a secondary reservoir or reticulated foam 98, a meter or cloth 100, a spreading material or fabric 102. The resiliency of the reticulated foam 98 keeps the holes 78 open. Without the reticulated foam 98, when the manifold 20 is pressed or slid upon a substrate, the meter 100 and spreading material 102 may work to close off the holes 78. The meter 100 and spreading material 102 may mat up and shut the holes 78. The reticulated foam 98 is a reservoir of paint that feeds the meter 100 and spreading material 102. The reticulated foam 98 is a manifold or directional device such that hole 78 need not be aligned with holes formed in the backing of the spreading material 102. Such backing is substantially impervious to fluid flow. The underside of manifold 20 is shaped so as to form a receptor for the reticulated foam 98. The foam 98 is preferably 45 pores per inch for wall paint. The pores may range from about 30 pores per inch to about 150 pores per inch.

Meter 100 is preferably a woven fabric with precision porosity so the paint can be metered as desired. For example, alcohol stain fluid may be used with a meter 100 having about six micron porosity. A meter 100 for wall paint may have about 12 to about 18 micron porosity. A meter 100 for textured paint may have about 50 to about 100 micron porosity. Generally, meter 100 may have from about six micron porosity to about 100 micron porosity. Porosity means the size of a pore. Meter 100 may be a polyester or a nylon or polypropylene.

Spreading material 102 may be woven polyester or a knitted polyester or a knitted polyester wool blend or a wool sheepskin or a polypropylene knit or a polypropylene tufted material or a nylon tufted material or a polyester tufted material or reticulated foam or brush bristles with or without flagged ends. Spreading material 102 includes a backing in which holes may be cut if the backing is impervious to fluid. Or the backing itself may be a meter whereupon a separate meter 100 may be deleted from apparatus 10.

It should be noted that the floor or bottom of the spreading material 102 may have a flat surface 104 or a arcuate surface 106 in the lateral or side to side direction. The flat and arcuate surfaces may be provided by a flat floor or bottom of the manifold 20 or 206 and by an arcuate floor or bottom 108 of manifold 20 or 206, respectively. If desired, the bottom or floor of the manifold or spreading material may be partially flat (such as in a medial portion) and partially curved or arcuate (such as on the side portions). The curve or arc provided to the spreading material 102 minimizes drag as the spreader or wiper 10 or 200 is wiped side to side across a surface.

Reticulated foam or secondary reservoir 98 is preferably set without adhesive into its receptacle on the underside of the manifold 20 so as to keep holes 78 open. Meter 100 and spreading material 102 are die cut to the size of the manifold 20 and then welded to each other and to the manifold 20 such as with an ultrasound welding method. Manifold 20 and other portions of apparatus 10 are preferably molded from a plastic material. Such plastic material is preferably high density polyethylene or polypropylene to withstand solvents.

Figure 17:
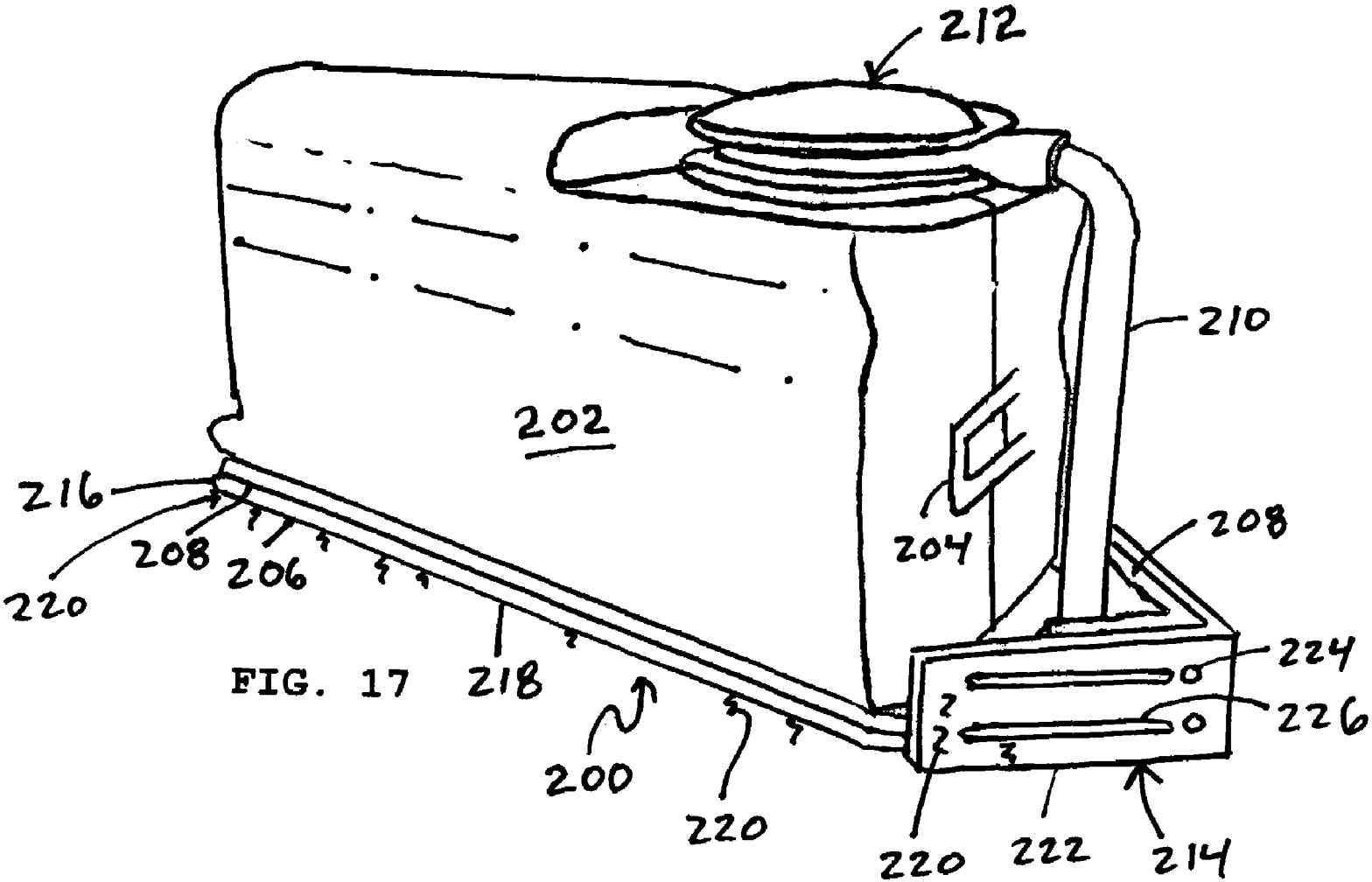
FIG. 17 is a perspective view of an alternate embodiment of the paint cartridge edger and spreader of the present invention.

FIG. 17 shows an alternate paint cartridge edger and spreader 200. Paint cartridge edger and spreader 200 includes a housing 202 having a living hinge on one end and a connection or buckle 204 on the other end, a manifold 206 and a manifold top 208, a main conduit 210, a pump 212, a corner spreader 214 on the manifold 206, an edger 216 on the manifold 206, a main spreader face 218 between the corner spreader 214 and the edger 216, and spreading material 220 diagramatically shown on corner spreader 214, the edger 216, and main spreader face 218.

Figure 21:
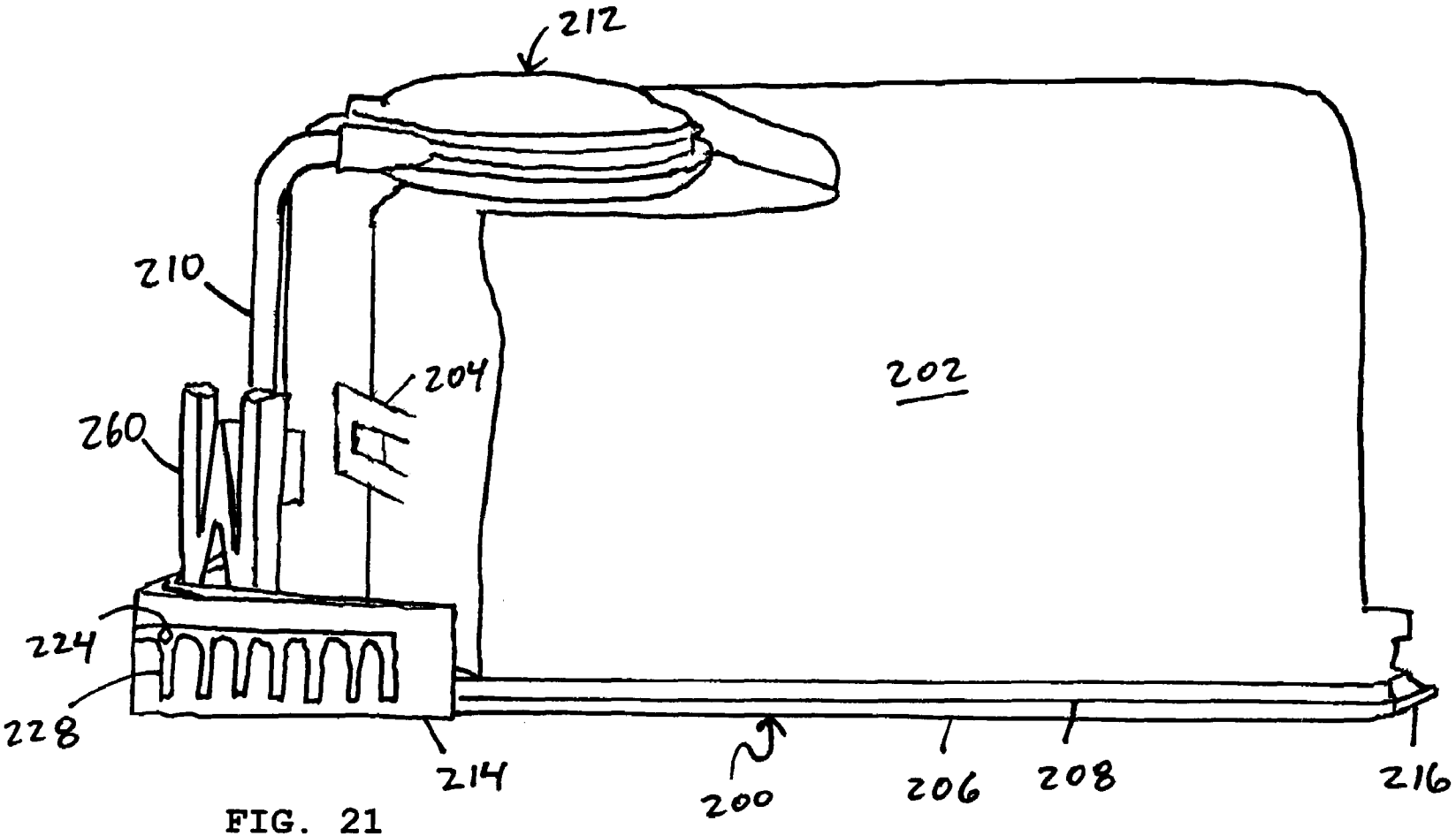
FIG. 21 is a perspective view of the embodiment of FIG. 17 with the additional feature of a control for controlling fluid flow to the corner spreader and main reservoir.

It should be noted that one definition of a manifold is a pipe or chamber having multiple or lateral apertures for making connections. Herein, each of manifolds 20 and 206 can have multiple lateral, longitudinal, vertical or oblique passages that interconnect or that are independent so as to control fluid flow and convey fluid from the distal end of the main conduit to the spreading material or to a main reservoir upstream from the spreading material. The passages may be internal or external. For example, the corner spreader portion 222 of manifold 206 has internal passages 224 to convey fluid from the distal end of the main conduit to the distal ends of passages 224. Corner spreader portion 222 further includes external passages or grooves 226 formed in a face of corner spreader portion 222 to distribute fluid about a rear face of the spreading material on the face of the corner spreader portion. Manifold 20 has internal passages or channels 76 to convey fluid from inlet 78.1 to outlets 78 that lead into main reservoir 98. External passages or grooves 228 are also shown in FIG. 21, where grooves 228 interconnect.

Figure 18A:
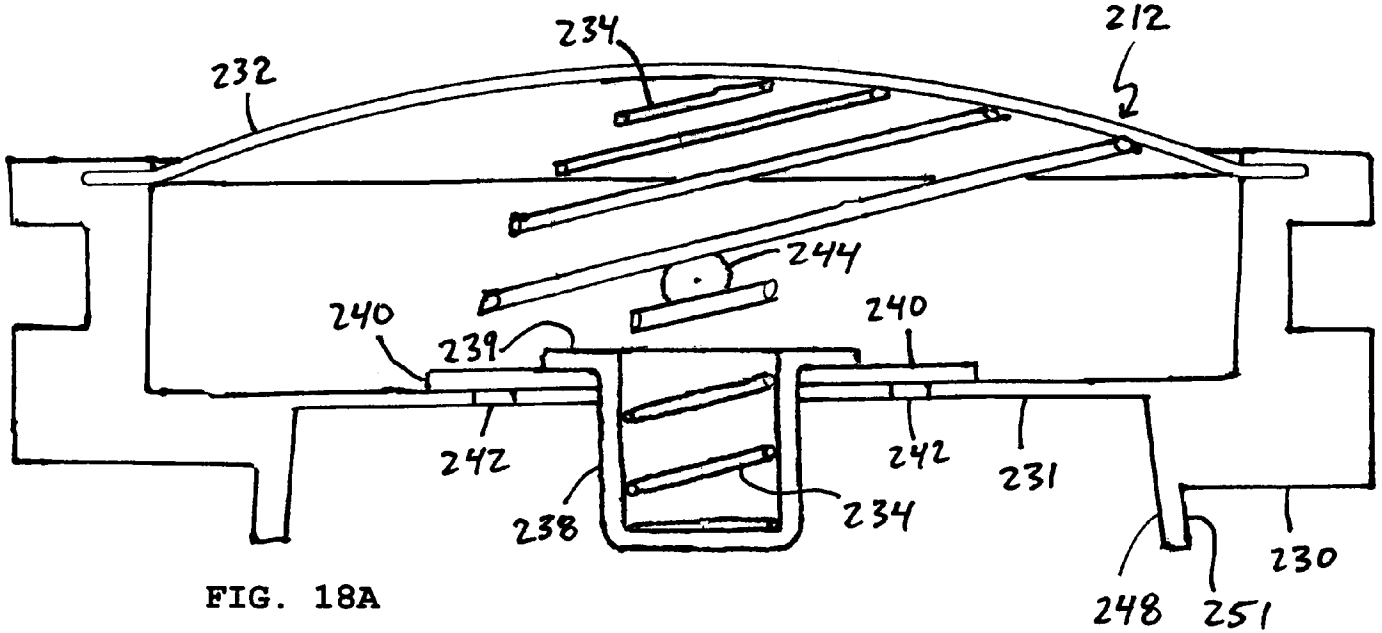
FIG. 18A is a diagrammatic section view of the pump for the embodiment of FIG. 17.
Figure 18B:
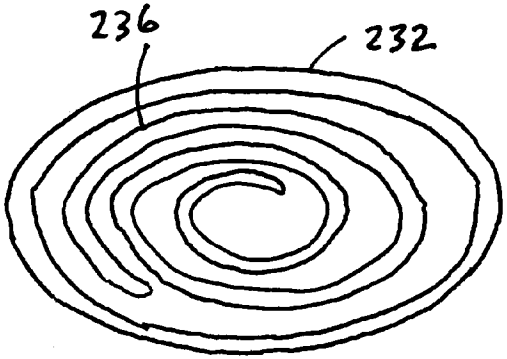
FIG. 18B is a diagrammatic view for the pressable lid of the pump of FIG. 18A.

Pump 212 is shown in detail in FIG. 18A. Pump 212 includes a main annular body or collar 230 having an apertured floor 231. A pressable disk like lid or cap 232 is fixed or pinched in the collar 230 so as to oppose the apertured floor 231 and is biased in the outward position via a helical or coil spring 234. Spring 234 is a resilient section of the apparatus 200 that operates to draw fluid from the paint cartridge 252. Portions of one end of the coil spring 234 bring pressure to bear on an inside surface of the cap 232 and can be held in place by embossing the cap 232, the inside face of which is shown in FIG. 18B. Reference number 236 indicates a spiral embossed portion in which spiral or helical portions of one end of the coil spring 234 can ride. An inner end of the coil spring 234 rides in a thimble shaped seat 238 that extends through floor 231 of the collar 230 via central opening 237 and into the paint cartridge. An annular flange 239 of the seat 238 rides upon a disk like diaphragm 240 that surrounds the seat 238. Diaphragm 240 in turn closes off and opens up apertures or inlets 242 formed in the apertured floor 231 of the collar 230. Diaphragm 240 is a one-way valve that closes off the paint cartridge when the lid 232 is pressed and that opens up the paint cartridge when the lid 232 is released.

Figure 19:
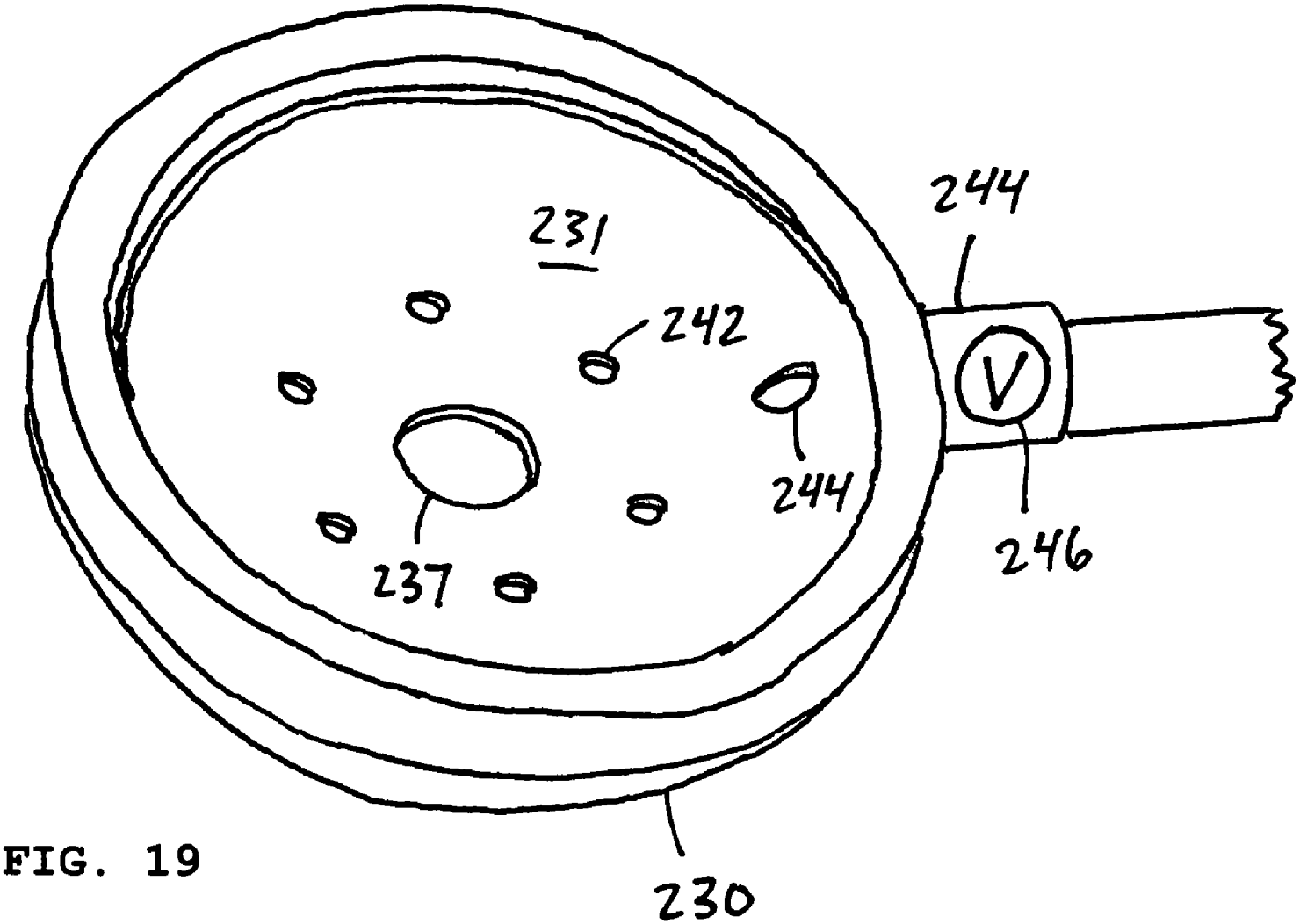
FIG. 19 is a perspective view of the main body of the pump of FIG. 18A.

As shown in each of FIGS. 18A and 19, main body or collar 230 includes an outlet 244. When lid 232 is pressed, fluid (such as gas or air or liquid or paint) is forced through outlet 244. Outlet 244 includes a one-way valve 246, such as a reed valve or ball valve, that permits fluid out of outlet 244 and away from the paint cartridge, when lid 232 is pressed so as to pressurize the inside of collar 230 until the one-way valve 246 is activated.

Paint is thereby drawn from the paint cartridge by repeatedly pressing and releasing cap 232. As cap 232 is pressed, one-way valve 240 is forced to close and one-way valve 246 is forced to open such that fluid is expelled from the interior of collar 230. As cap 234 is released, one-way valve 240 is forced to open and one-way valve 246 is forced to close such that fluid is drawn into the interior of collar 230.

Figure 20:
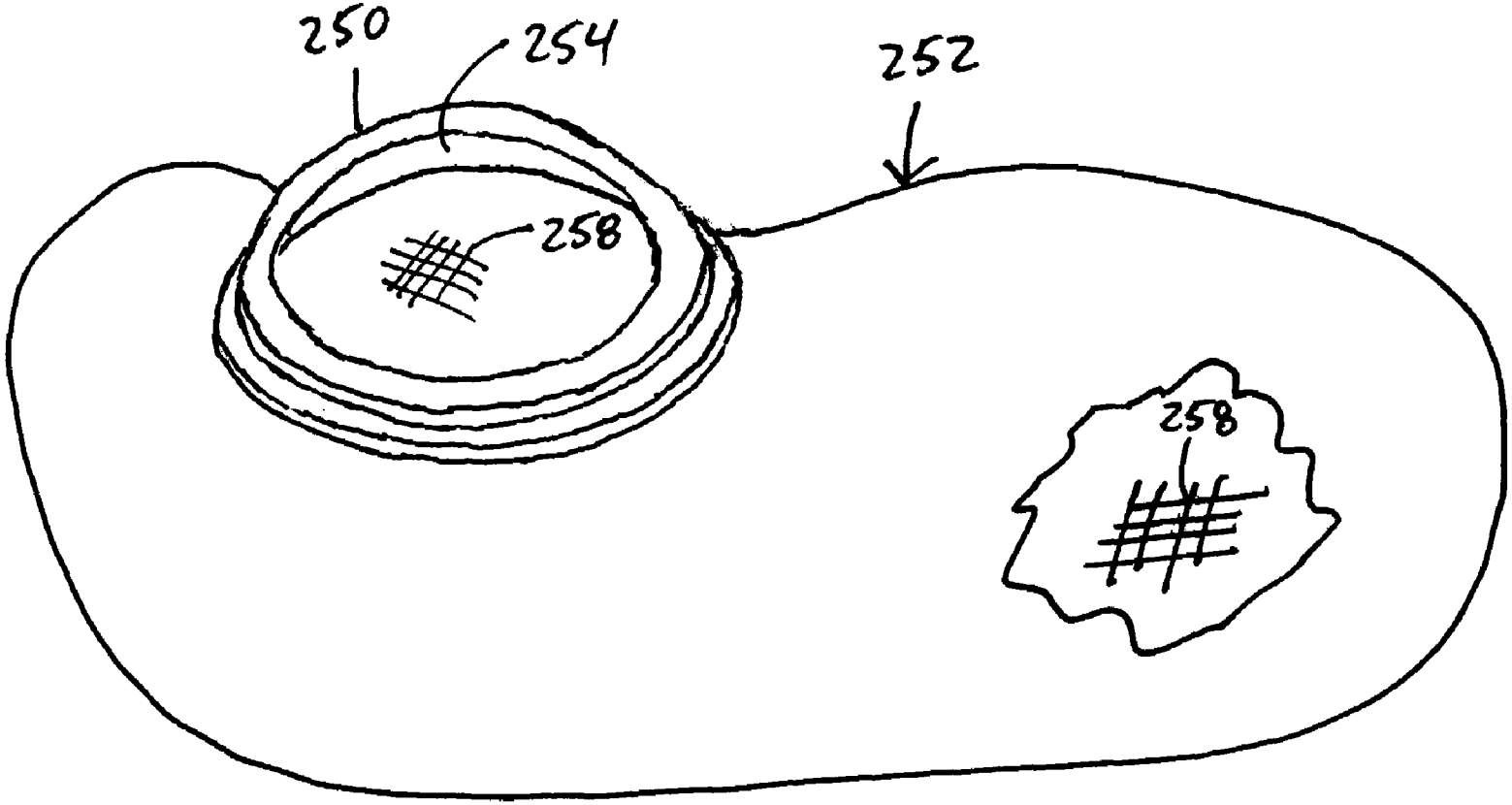
FIG. 20 is a perspective, partially cut way, view of an alternate embodiment of the paint cartridge of the present invention.

Collar 230 further includes an annulus 248, shown in FIG. 18A, that engages a collar 250 of a paint cartridge 252, shown in FIG. 20. If collar 230 has a central vertical axis, then an outside annular face of the annulus 248 extends downwardly and outwardly relative to such a central axis. Such a configuration provides a relatively tight snapping seal to a collar 250 of paint cartridge 252, where the collar 250 includes an inner annular face 254 that extends downwardly and inwardly relative to such central axis.

A paint or coating bag 256 is pinched to the collar 250 or glued or welded to an end face of the collar 250. Bag 256 preferably is plastic and includes an inner roughened surface 258. Inner roughened surface 258 may be an embossed surface. Inner roughened surfaces minimize clinging of the inner surfaces to each other such as when a negative pressure or negative pressure flow is being caused inside of the bag via the pump 212. When fluid is being drawn from the bag 256, inner surfaces 258 may be drawn together, but the relative lack of surface tension of the roughened inner faces keep such drawn together surfaces from acting like a seal to seal off a portion of the bag through which fluid may not flow.

FIG. 21 shows the embodiment of FIG. 17 with the additional feature of a control 260 for raising and lowering a height of a distal end 262 of the main conduit 210. Control 260 is an integral molded piece of plastic having barbed legs 264. A squeezing together of ends 266 draws leg ends 268 apart, and a subsequent release permits the naturally biased ends 266 to swing toward each other. Barbs or detents 268 on the inner lower ends 266 disposed at different relative heights engage a corresponding barb or ledge on manifold 206 (such as on manifold top 208) to raise or lower distal end 262 of main conduit 210, a portion of which is fixed in and extends through opening 270 in control 260.

Figure 22B:
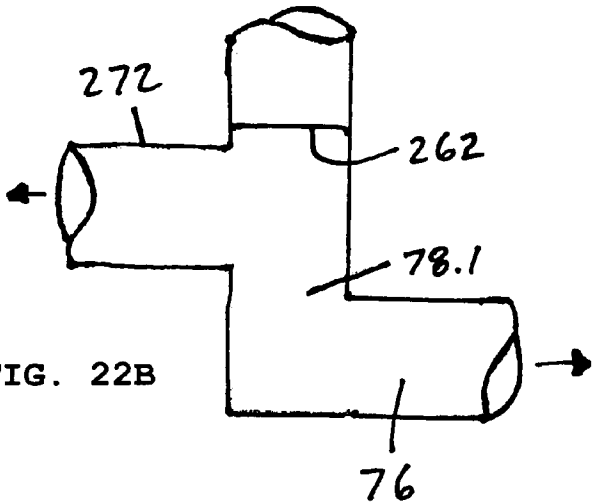
FIG. 22B is a diagrammatic view showing how the control of FIG. 22A fixes the main conduit at a location that permits fluid flow to each of the corner spreader and main reservoir.

FIG. 22B shows that distal end 262 is disposed above an internal passage 272 leading to outlet 224 of the corner spreader 214 and above inlet 78.1 and internal passage 76 such that fluid may flow both to the corner spreader 214 and to main reservoir 98. The distal end 262 or the distal end portion of the main conduit 260 is hence a shut off valve to the corner spreader 214.

Figure 22C:
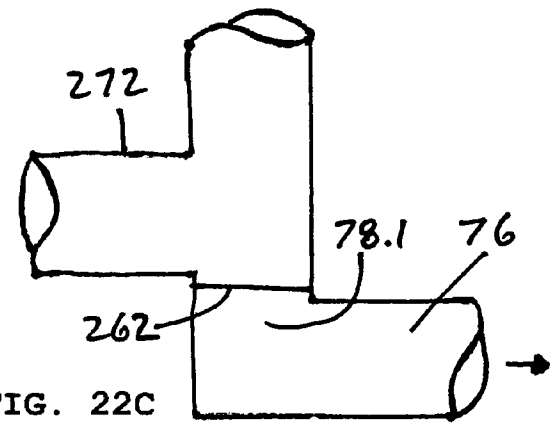
FIG. 22C is a diagrammatic view showing how the control of FIG. 22A fixes the main conduit at a location that shuts off fluid flow to the corner spreader and, at the same time, permits fluid flow to the main reservoir.
Figure 22A:
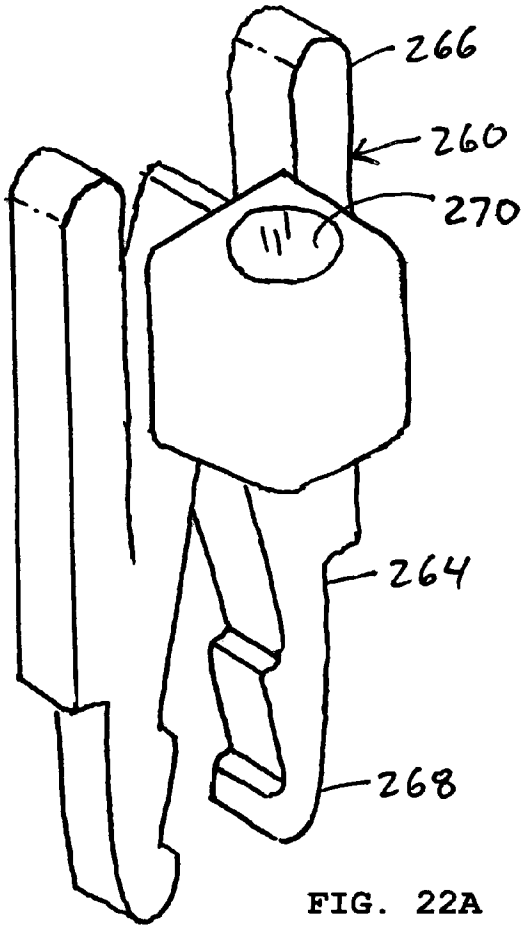
FIG. 22A shows a detailed perspective view of the control of FIG. 21 for manipulating fluid flow to the corner spreader and main reservoir.

FIG. 22C shows that distal end 262 is disposed below internal passage 272 leading to outlet 224 of the corner spreader 214 and above inlet 78.1 and internal passage 76 such that fluid is shut off to the corner spreader 214 and flows freely to the main reservoir 98.

Figure 23:
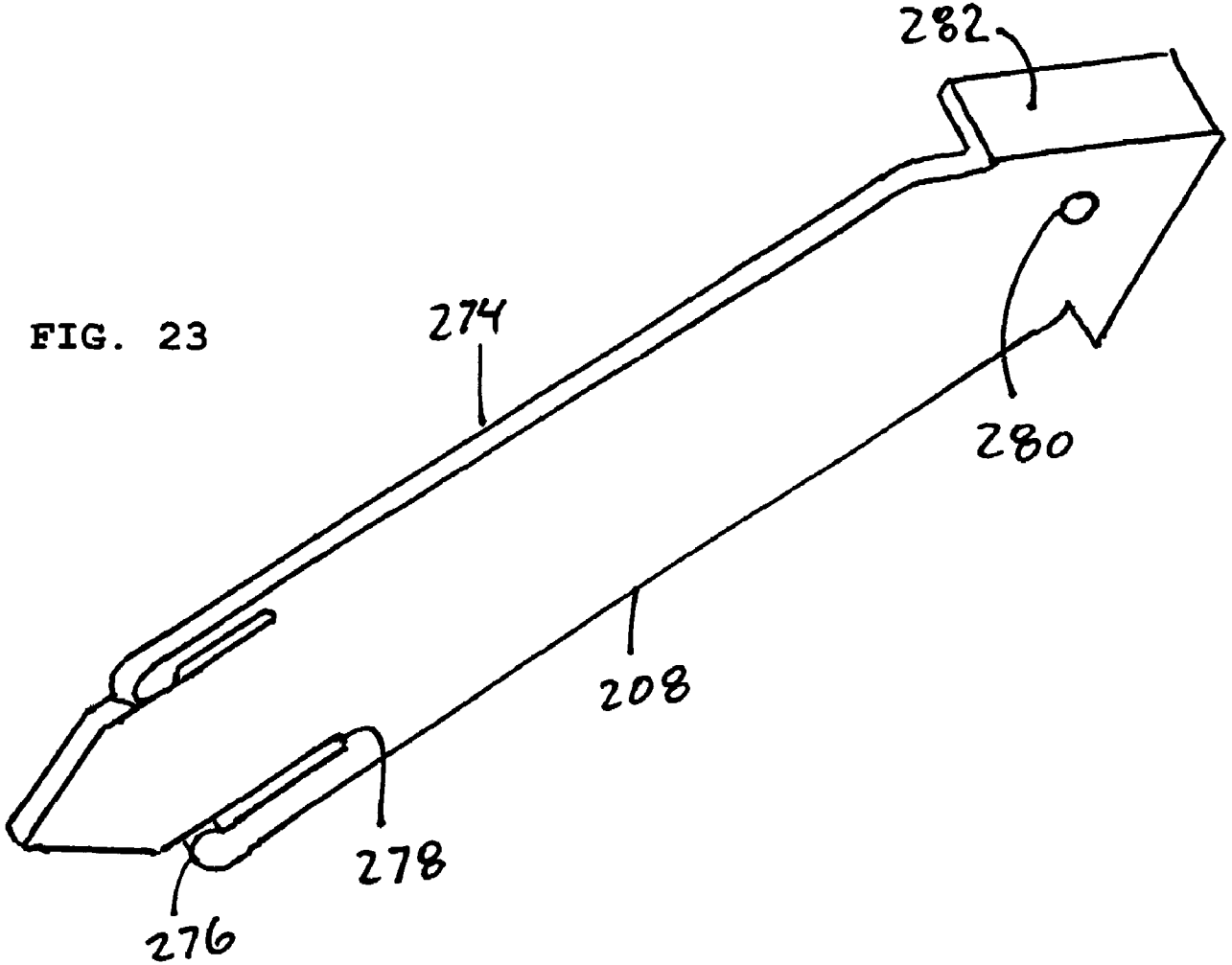
FIG. 23 shows a perspective bottom view of an alternate embodiment to the top of the manifold, illustrates a lock or latch for locking the manifold top to the housing, and further illustrates a support for the corner spreader of the manifold.

FIG. 23 shows another embodiment of a manifold top. Here manifold top 274 includes inwardly turned detents or tabs 276 that close off slots 278 that can engage prongs or tabs on the underside of housing 202. Manifold top 274 further includes an opening 282 for main conduit 210 and support faces 282 disposed at ninety degrees relative to each other for confronting and supporting the corresponding faces of the corner spreader 214.

Figure 24B:
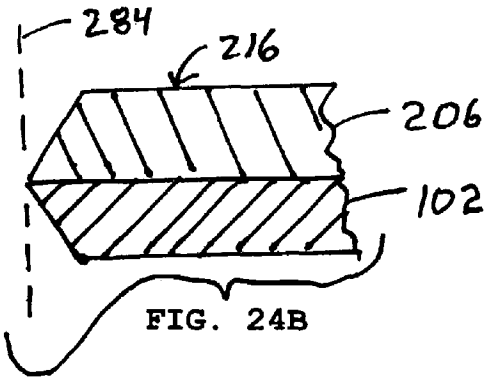
FIG. 24B is a section view that shows how the spreading material can be angled back from a surface to be coated and that further shows how the side face of the manifold can be angled back from the surface to be painted such that the paint cartridge and spreader makes contact with the surface to be painted at only one point or one line.
Figure 24D:
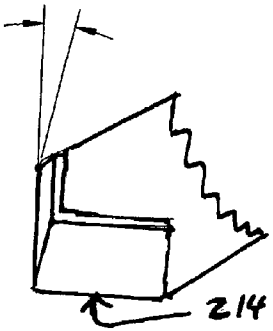
FIG. 24D shows a perspective partial view of an alternate embodiment of the manifold of FIG. 10 and in particular shows a compound corner spreader.
Figure 24C:
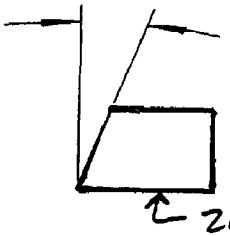
FIG. 24C shows a side view of a compound corner spreader face.
Figure 24A:
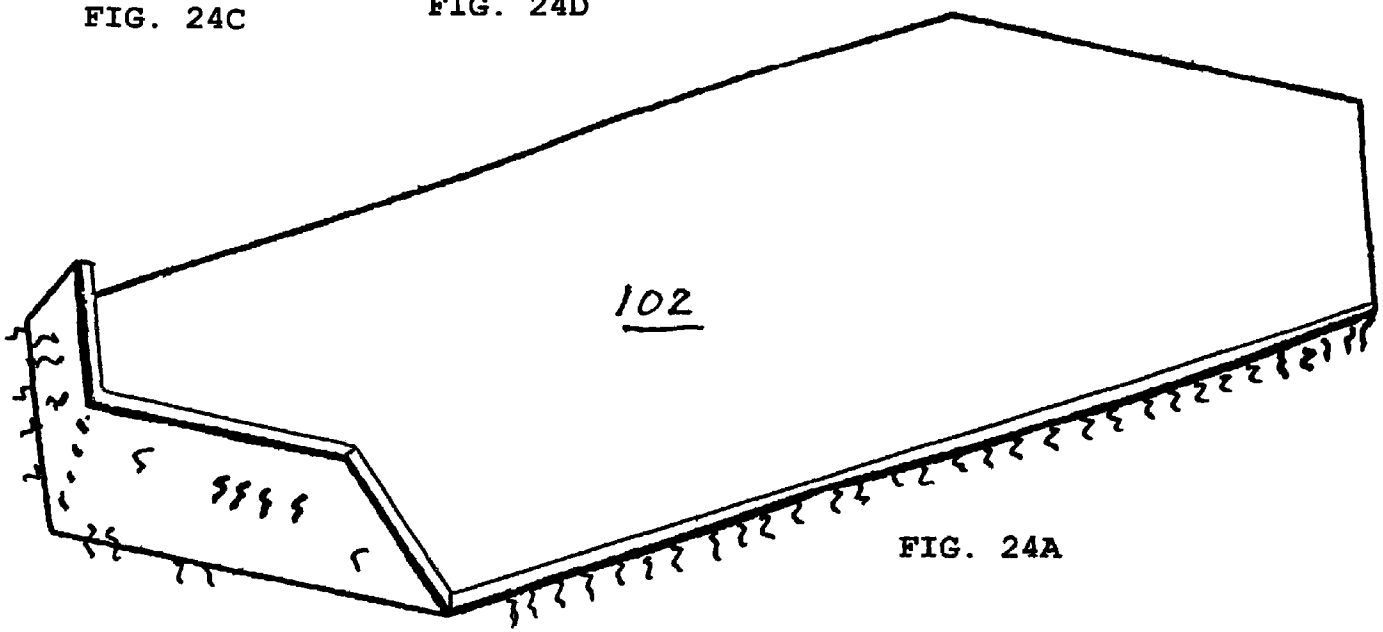
FIG. 24A shows a diagrammatic perspective view of the spreading material that is engaged to the manifold of FIG. 10.

FIG. 24A shows the spreading material 102 that overlays the bottom of the manifold 206 and that overlays the faces of the corner spreader 214.

FIG. 24B shows a section view of the spreading material 102 and manifold 206, particularly looking along a side edge of the spreading material 102 and manifold 206. To provide a one point contact or contact along generally one line, each of the side edge of the spreading material 102 and the side edge of the manifold 206 is not flush with a surface 284 to be painted but forms an acute angle relative to the surface 284 to be painted. Such a feature can be formed along edge 86 of manifold 20 (or the corresponding edge of manifold 206) or along edger edge 92 of edger 90 (or along the corresponding edge of edger 216). Such a feature minimizes or eliminates the need for a shroud.

Figure 10:
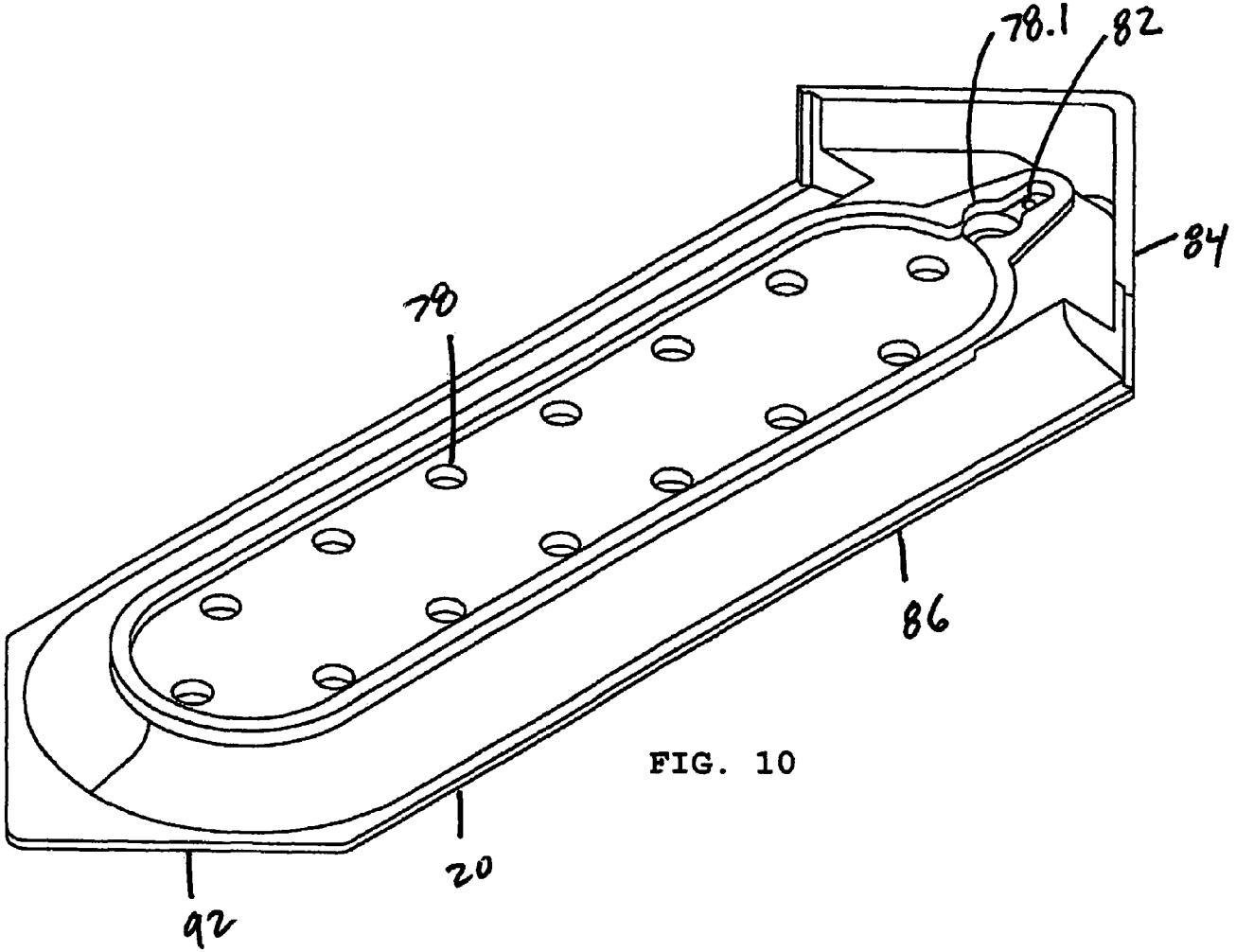
FIG. 10 is a detailed perspective view of the main body of the manifold of FIG. 1E.
Figure 11:
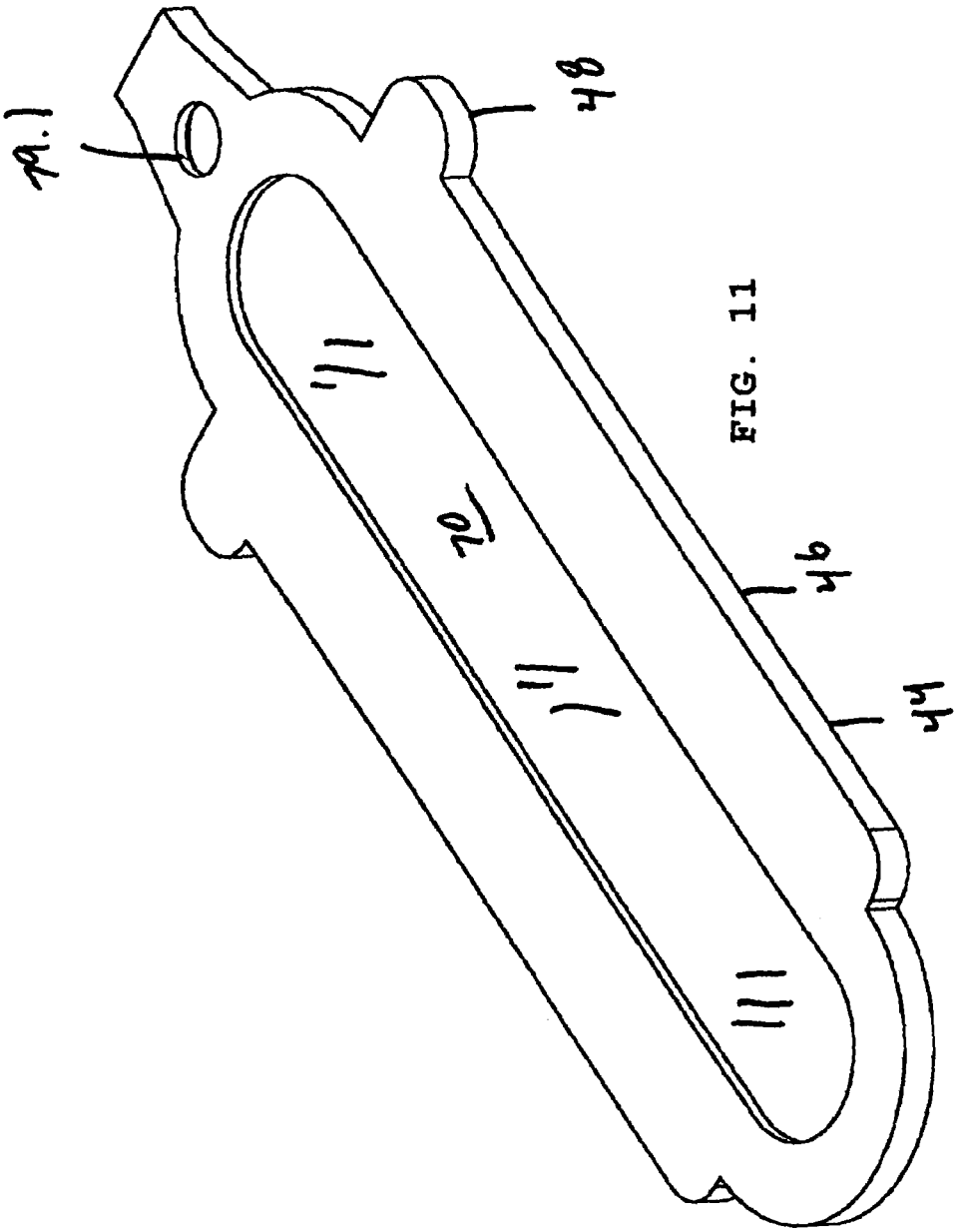
FIG. 11 is a detailed perspective view of the top for the manifold of FIG. 10.
Figure 12:
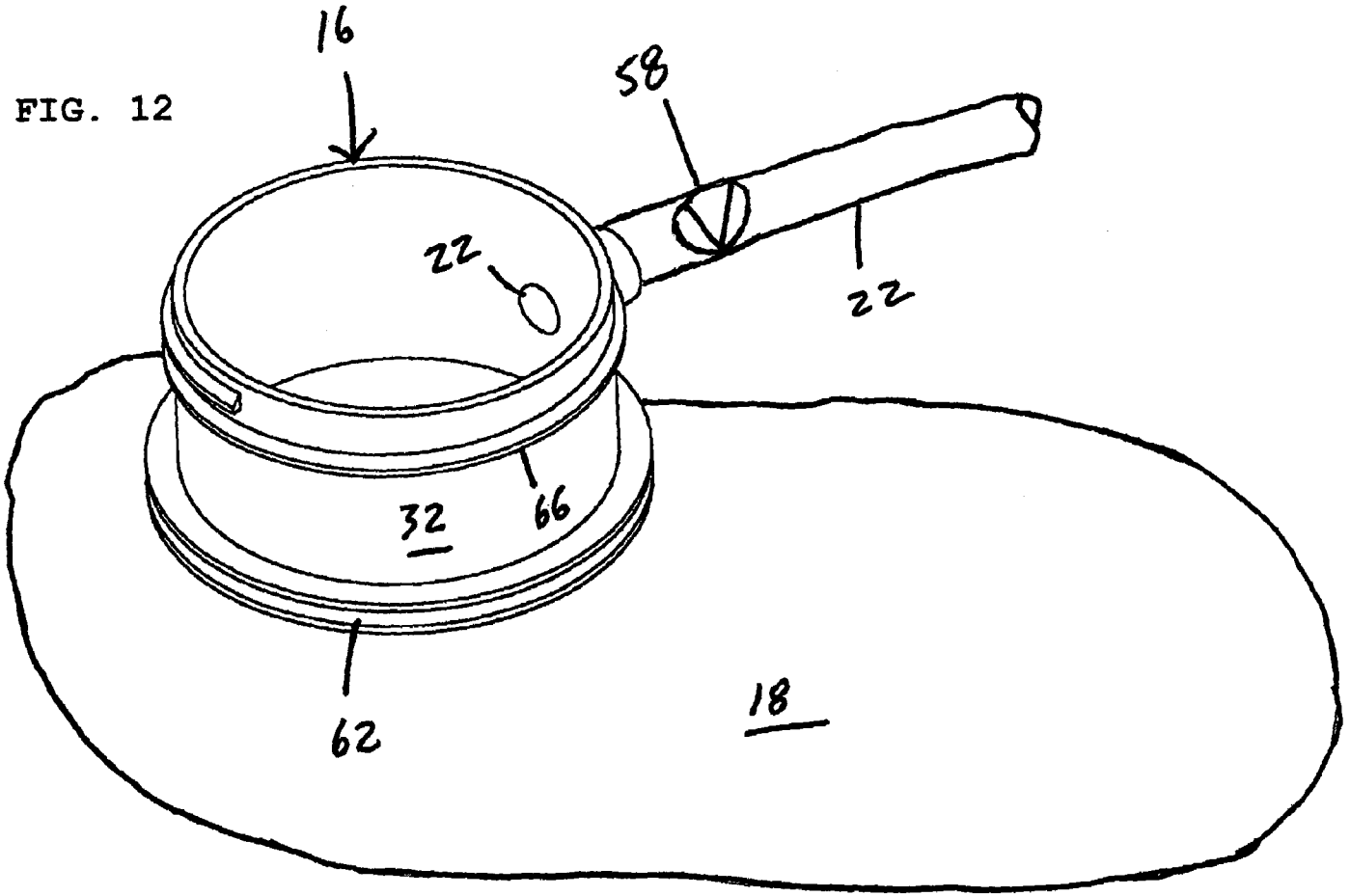
FIG. 12 is a detailed perspective view of the paint cartridge of FIG. 1C.
Figure 13:
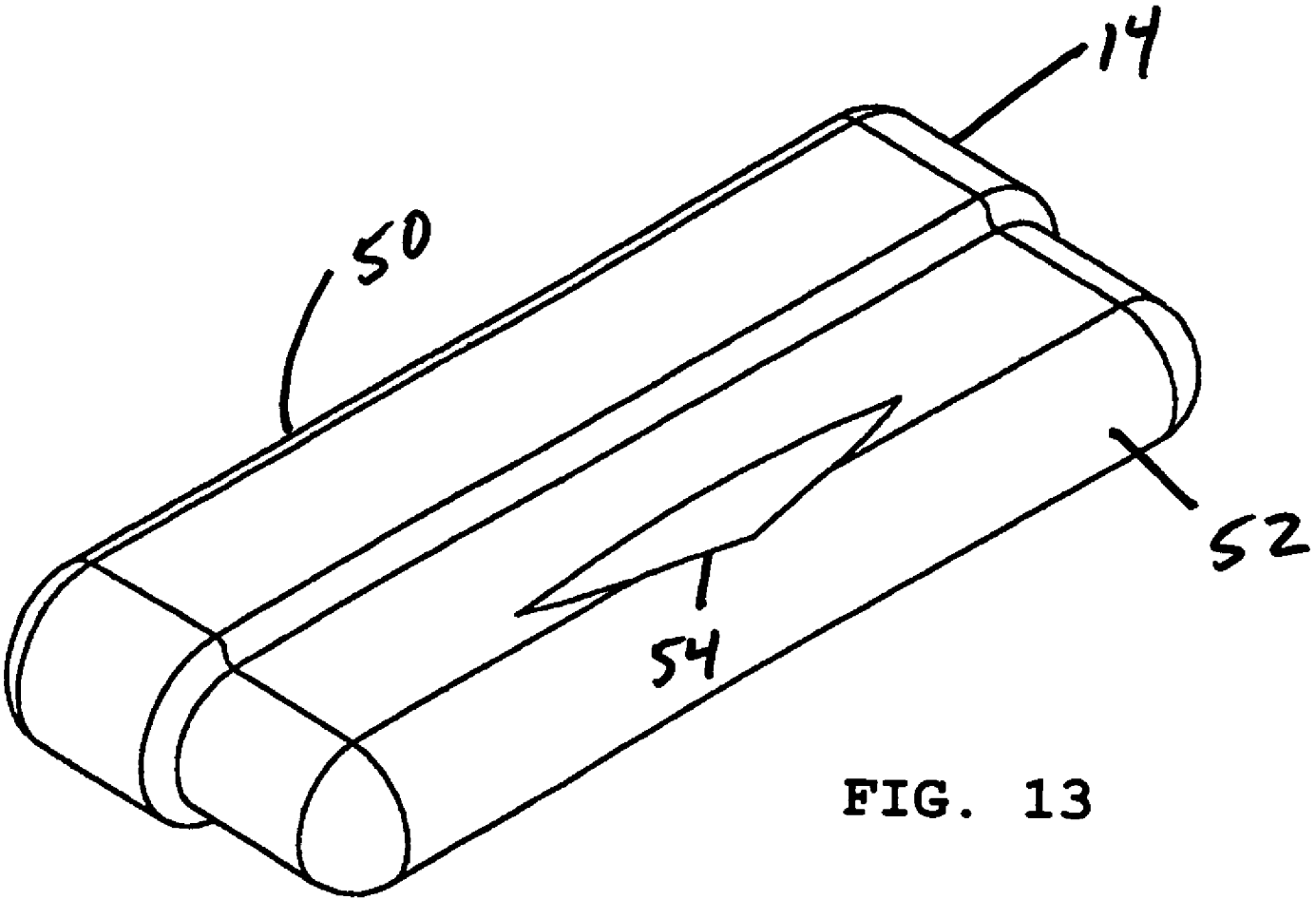
FIG. 13 is a detailed perspective view of the piston of FIG. 1B.
Figure 14:
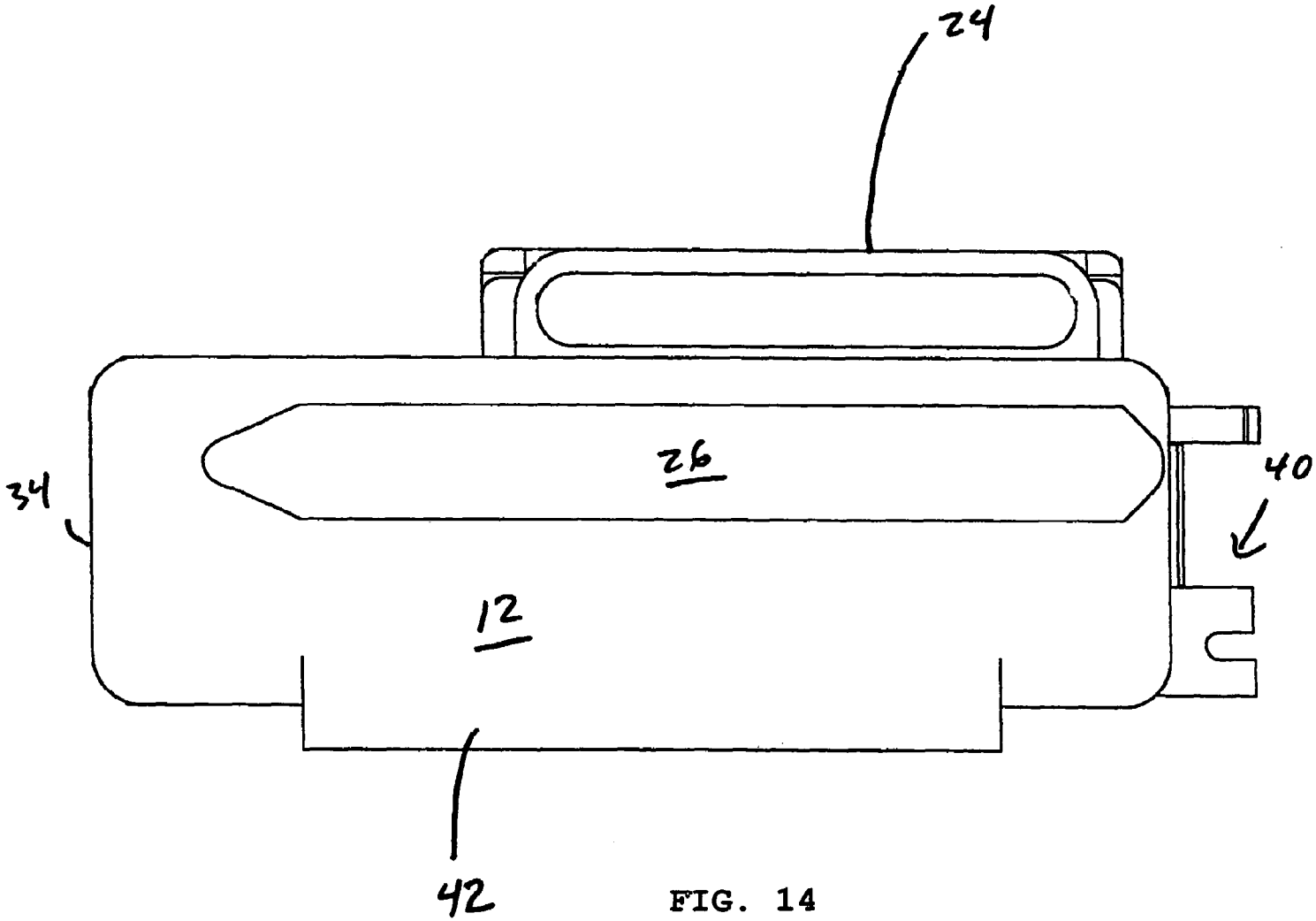
FIG. 14 is a side view of the housing of FIG. 1A.
Figure 15:
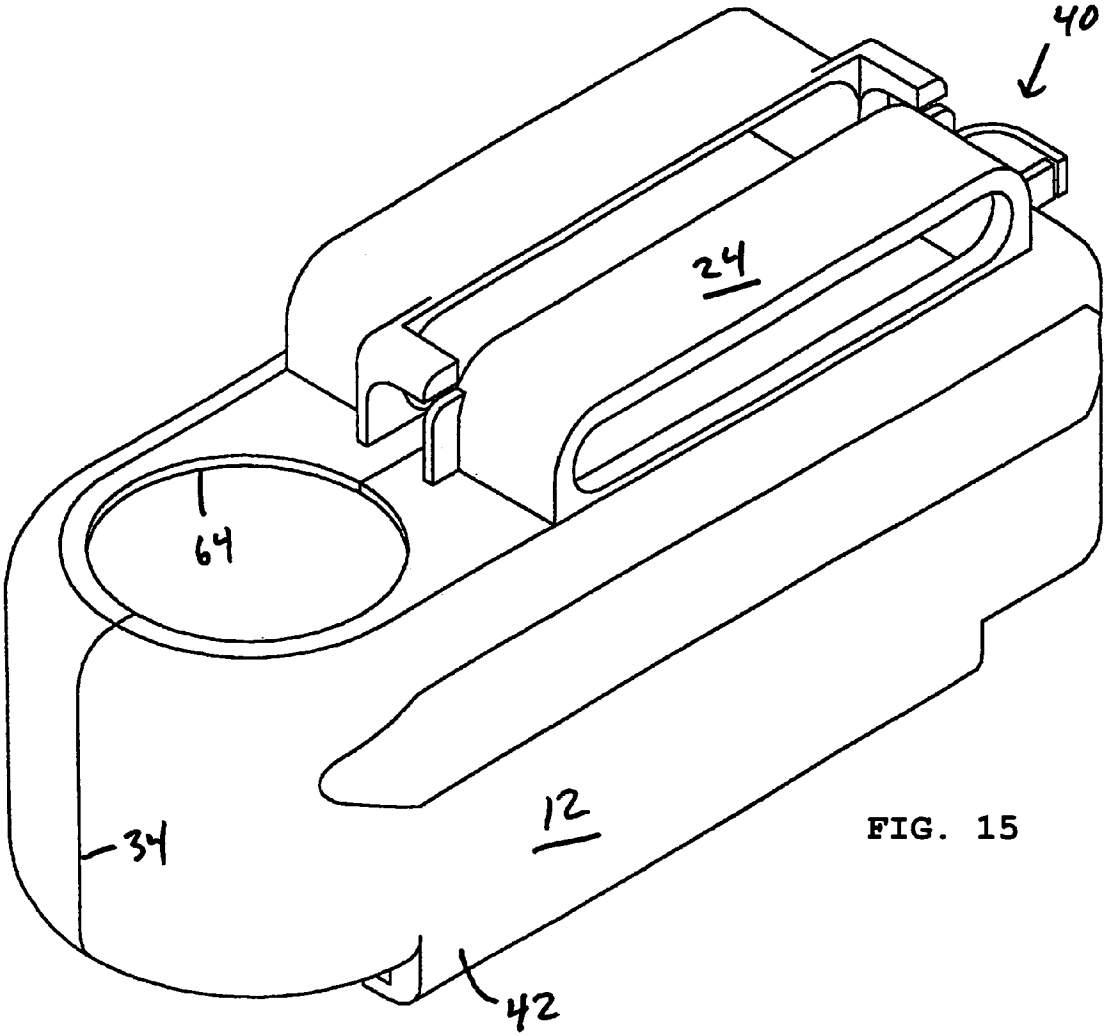
FIG. 15 is a detailed perspective view of the housing of FIG. 1A.

FIG. 24C shows a side view of a compound corner spreader face. FIG. 24D shows a perspective partial view of an alternate embodiment of the manifold of FIG. 10 and in particular shows a compound corner spreader. A compound angle is an angle measured by a vector with three nonzero components. A plane, or features on a plane, not perpendicular to at least one of the three principal coordinate planes is constructed using a compound-angle relationship to its coordinate system. Here such a plane is any of the corner spreader faces of FIGS. 24C and 24D, where the three principal coordinate planes are defined by the floor of the manifold, the side face of the manifold, and the surface being painted, when such a surface is perpendicular to the other two planes. Such a compound corner spreader permits the spreading material 102 to be tucked into space created by the compound angle so the corner spreader 214 can get into a corner more tightly.

It should be noted that pump 212 can fit in housing 12 with no modification of housing 12. Pistons 14 simply are not used.

It should be noted that pump 212 can be operated with a finger or can be operated with the heel of one's hand.

It should be noted that manifolds, whether manifolds 20 or 206 or some other configuration of a manifold, can be structured such that inlets 79.1 and 78.1 (that confront and engage the distal end of the main conduit) are proximate the edger end portion instead of the corner spreader end portion. Or such manifolds can be structured to have inlets 78.1 and 79.1 at both of the edge end portion and corner spreader end portion, where the unused inlets are closed off by mating sealing plugs extending from the housing to keep fluid pressure in the direction of the main reservoir and spreading material 102.

It should be noted that the profile of the paint cartridge edger and spreader 10 and 200 may be lowered and widened and, at the same time, keeping the volume of the paint cartridge the same and keeping the surface area of the spreading material 102 the same. An advantage of a lower paint cartridge edger and spreader is that one's hand is closer to the surface being worked upon, thereby minimizing the chances of toppling or rolling of the apparatus 10 or 200.

It should be noted that the pump 212 or pistons 14 may be electrically operated. Housings 12 and 200 can contain batteries for such an operation. The closing and opening of the sides of the housings 12 and 200 can open and close electrical switches.

It should be noted that one advantage of the apparatus 10 and 200 is that such are easily broken down for cleaning. For example, pump 212 can be detached, held under water, and operated to draw water into and out of the pump 212 to thereby clean the pump 212.

It should be noted that manifold 20, manifold 260, and meter 100 contain passages or conduits for the control of fluid flow. The passages or conduits in the manifolds 20 and 260 are relatively large. The passages or conduits in meter 100 are relatively small. Depending upon the backing of the spreading material 102, such backing may be a meter. Spreading material 102 with impervious or generally impervious backings may be used by punching holes in such impervious backing.

Manifold 20 or 206 can be designated as a base. For example, a main conduit may convey fluid directly to spreading material on the base without conduits, lateral or otherwise, in the base.

It should be noted that one of the ends of the base or manifold 20, 206 is designated a first end, with the first end having two faces extending at generally right angles relative to each other and at generally a right angle relative to the floor of the base, with the spreader further comprising spreading material engaged at least partially on said faces of the first end, whereby said first end is a corner spreader end.

It should be noted that one of the ends of the manifold 20 or 206 or base is designated a second end, with the second end having two faces extending at generally right angles relative to each other and at generally a right angle relative to the floor of the base, with the spreading material terminating immediately at floor portions leading immediately into said faces of the second end, and with said two faces of the second end being free of said spreading material, whereby said second end is an edger end.

It should be noted that the manifold or base includes a rectangular portion and two generally triangular portions, with the triangular portions being opposite of each other, with each of the triangular portions being set at opposite ends of the rectangular portion, such that one of the triangular portions forms a support for a corner spreader end and such that the other of the triangular portions forms a support for an edger end.

Spreader 10 and 200 can be operated when disposed in any position, i.e., right side up, upside down, with the main rectangular body of the spreading material 102 making contact with a vertical wall, or in an oblique position.

The spreading material 102 includes generally two structures: a backing and the fiber cushion or network. The backing engages the fibers of the fiber cushion and provides a surface for adhesive or other bonding method to fix the spreading material 102 to the base or manifold. The fiber cushion is a network of fibers where some of the fibers run in a direction toward and away from the floor of the base or manifold and where some of the fibers run in a direction crosswise relative to the floor of the base or manifold. The fiber cushion is preferably a noncell cushion. The fiber cushion is preferably a nonfoam cushion. A network of fibers picks up a relatively great load of paint or coating and deposits such paint or coating when a pressure is exerted upon the network.

The fiber cushion is gently resilient as a whole and each of the individual fibers of the fiber cushion may be elastic and resilient. The fiber cushion includes a relatively great density or concentration of fibers. The concentration of the fiber may be as concentrated as wool, that is, up to generally about 10,000 fibers per square centimeter.

The shape of a fiber of the fiber cushion may be in the form of a hollow or solid tube or cylinder. More preferably, the shape of a fiber of the fiber cushion is irregular such that the fiber includes laterally extending features as well as longitudinally extending features, such as does a wool fiber, which has a three dimensional corkscrew pattern, or helical crimp. Such a fiber occupies more space than if it was a simple tube or cylinder. Further, such a fiber interacts with other fibers to provide networks or pockets to which and in which paint and coatings can cling and collect. Simple tube or cylinder like fibers provide significantly no such networks and pockets. Further, the fiber may include scales or loops on the exterior of the fiber. The scales, loops and other irregular features provide a means for fibers to engage each other to provide a network of fibers. Such a network has a great amount of surface area or wetting area for a coating.

The fiber of the fiber cushion is preferably as flame and shrink resistance as natural wool, has the water/oil repellency of natural wool but is also as absorbent as natural wool, has the anti-static properties of natural wool, and is as resistant to the generation of moths as is natural wool.

The preferred fiber of the fiber cushion is as inherently non-flammable as wool and is as difficult to ignite as wool, has the low flame spreading and heat release properties of natural wool, and further has the little smoke and toxic gas emission properties of wool.

The fiber of the fiber cushion may be a thermoplastic fiber. Some thermoplastic fibers are polyester fibers and polypropylene fibers.

The fiber cushion may include fibers in unblended form or in a form blended with other fibers.

The fiber cushion may include animal fibers such as wool fibers, alpaca fibers, mohair fibers and silk fibers, plant fibers such as cotton fibers, flax fibers, hemp fibers, and jute fibers, synthetic fibers such as nylon, polyester, polyolefin, acrylic, dacron, and rayon fibers. "Shirpa" fabric includes a network of plastic fibers, though for the present spreader "shirpa" fabric leaves fine distortions in a paint film rather than the preferred electrostatic like flat finish.

Among synthetic fibers, nylon is less preferred where surface tension is desirable for picking up paint because nylon has relatively poor surface tension for picking up liquid coatings. However, where it is desirable to decrease drag on a surface to be painted, nylon can be preferred. A best of both worlds is a nylon tufted material where the distal ends of the nylon fibers are flared or tufted or flagged to keep paint from running off until pressure is applied.

Among synthetic fibers, where surface tension is desired, polyester fibers are preferred because polyester fibers have relatively good surface tension properties for coating materials.

Among natural fibers, cotton is less preferred because it is absorbent as to some materials.

The fiber cushion preferably does not include bristles. A bristle is stiff. A bristle is a stiff hair. A bristle stands erect. Bristles run generally parallel to each other. A bristle is sharp. A bristle is cylindrical in shape. The present fiber cushion is soft and includes fibers running in generally all directions.

With fibers extending from the backing, the fiber cushion is in the nature of a carpet. The fiber cushion has a relatively high recovery rate from substantial deformations. The fiber cushion has a relatively high density. The fiber cushion possesses good dimensional stability under environmental changes and twist-sets well. The fiber cushion has superior handle and resistance to static development.

The fiber cushion may be textured. In texturing, filaments are crimped and looped at random, and finally heat-set, to give the fiber cushion as a whole greater volume or bulk. Such a treatment may provide a permanent helical deformation to the filament in the nature of wool.

The fiber cushion may be a woven fiber cushion or a nonwoven fiber cushion.

The fiber cushion is absorbent as to water, water-based paints and coating, oil, oil-based paints and coatings, polar solvents and nonpolar solvents, latex, coatings for floors, walls, ceilings, and coatings for wood, plaster, cement, sheet rock and other substrates.

Preferably the fiber cushion includes fibers that are merely surface wetted and are not absorbent. In other words, the fiber cushion as a whole is absorbent; however, the individual fiber is preferably not absorbent so that paint or other coating or water does not penetrate the fiber. Some natural fibers are absorbent; others are nonabsorbent. Some synthetic fibers are absorbent; others are nonabsorbent. Some natural fibers may be coated so as to make the individual fiber nonabsorbent. Wool fiber be coated so as to be nonabsorbent.

Unlike wool, the network of fibers does not bunch up or knot up or pack up when wet. It is believed that wool behaves as such because the individual wool fiber is porous. With the present spreader, the individual fiber of the fiber network is preferably nonabsorbent and nonporous to water, oil, latex, resin, paint, varnish, stripper, enamel, paste, glue, polish, stain, and cement.

The fiber network or cushion may be a knitted pile fabric with the pile portion 100% wool not lower in grade than 56's U.S. Standard. Backing may be 100% spun polyester. The finished cloth may weigh as little as 13 ounces per square yard.

Whereas with a conventional paint brush or paint roller a relatively great amount of vehicle (water or oil) must be used, relatively less vehicle is required with the present fiber network. Accordingly, painting is more efficient.

Since the fiber network includes individual fibers that are nonporous and nonabsorbent, the fiber network is relatively easy to clean with water or a solvent.

The preferred fiber network or cushion can be provided by woven spreading materials, polyester spreading materials, lint free and woven polyester spreading materials, knitted polyester spreading materials, wool spreading materials, knitted polyester and wool spreading materials, polyester wool blends.

The depth of the fiber network may be from about one-eighth of an inch to about one and one-half inches. For painting conventional sheetrock surfaces, the fiber network preferably has a depth of about one-half inch. For painting textured surfaces, the fiber network preferably has a depth of about three-quarters of an inch. For applying varnish or stain to a surface, such as a rough cedar deck, the fiber network preferably has a depth of about three-quarters of an inch. For applying a coating to block or stucco, the fiber network preferably has a depth of about one and one-quarter inches. In each of these cases, a preferred fiber network is a polyester or acrylic knitted fabric or fiber network.

The fiber cushion or network may be a woven or knitted velour or velvet of, for example, 10-12 denier. A woven velour fiber cushion or network is preferred for varnish and for glass surfaces.

For relatively coarse or rough surfaces, fibers of a relatively large diameter are preferred. For relatively smooth surfaces, finer fibers having a lesser diameter are preferred so as to provide a flatter finish.

The fiber cushion or network is preferably free of lint or includes minimal content of lint. A fiber that includes an acrylic or modified acrylic is one preferred lint-free fiber or fiber having a lint content that has been minimized. A fiber that includes polyester is another preferred lint-free or minimal-lint fiber.

The fiber cushion or network preferably includes a fiber that does not shed.

The fiber cushion or network may be a woven fiber cushion or network. The fiber cushion or network may be a nonwoven fiber cushion or network. The fiber cushion or network may be a nonwoven knitted fiber cushion or network. A knit is a structure where fibers or yarns are looped around each other, and such loops may or may not be broken. The knit of the fiber cushion or network may be a sliver knit.

The fiber cushion or network may have a denier of about 3 to about 60. The fiber cushion or network, or the spreading material, may have from about 16 to about 28 stitches per inch. The fiber cushion or network may have from about 40 to about 52 piques per inch.

The fiber cushion or network is preferably a cushion of fibers that works relatively quietly on a surface. Painting with a conventional paint brush or conventional paint roller is a relatively noisy method of painting.

At least some, and preferably all, of the fibers of the fiber network include a coating to reduce drag when the fiber cushion works upon a surface. Such a coating preferably is 1) a silicon based coating or 2) a chemically stable perfluorinated high polymer such as polyhexafluoropropylene or a copolymer of hexafluoropropylene and tetrafluoroethylene such as Teflon® (from DuPont) or Scotchguard® from Minnesota Mining and Manufacturing. Such coatings decrease the surface tension of the fiber network so as to decrease the drag of the fiber network over a surface being worked upon. At the same time, a fiber network treated with such a coating maintains a large capacity for loading paint. Fluoro polymer and silicon coatings, as indicated above, further provide the individual fiber with a nonporous and nonabsorbent structure to permit the fiber to retain its resiliency. In other words, prior to fibers of the fiber cushion being coated, the fibers have a given drag upon a given surface with a given pressure. However, after each of the fibers are coated with a drag reducing coating as indicated above, then the given drag upon said given surface with said given pressure is reduced.

As indicated above, with the slight curvature or slight radius or slight arc segment, the spreading material 210 too takes up such slight curvature or slight radius or slight arc segment so minimize the edges of the spreading material from catching on the surface being worked upon (minimizing drag) and to maximize a sliding of the spreading material over the surface being worked upon. Accordingly, the non-cell and nonfoam fiber cushion may be one of i) generally planar between the sides and ii) slightly curved between the sides.

The spreading material 102 preferably includes a depth less than each of the width and length of the spreading material 102 (or less than each of the width and length of the base or manifold), such as less than one-half or less than one-third of the width of the spreading material 102. The depth of the spreading material 102 is preferably between about 0.1% and 50% less than the width of the spreading material 102 with a more preferred range being between about 10% and 45%, with an even more preferred range being between about 20% and 40%, with an even more preferred range being between about one-fourth (generally 25%) and about one-third (generally 33%) less than a width of the spreading material 102. The width of the spreading material 102 is preferably less than a length of the spreading material 102, more preferably less than about one-half or 50% of the length of the spreading material 102, more preferably less than about 40% of the length of the spreading material 102, and most preferably about one-third of the length of the spreading material 102.

One embodiment of the present apparatus or tool is hand-held with an air pump in the handle. The tool has a replaceable bottom or manifold which allows the user to select from at least ten different bottoms or manifolds depending on what the user is painting and what type of materials the user is using. The cartridge or bag of the tool holds a little over one U.S. Quart of material or fluid per fill. Because the manifold of the tool utilizes almost all the standard fabrics used to make roller covers for painting, the cartridge can apply all of the same fluids. Because the cartridge may include a strong bag such as a double-membrane saddle type bag that is pressurized to force the fluid out into the fabric or spreading material, heavier than usual fluids can be used. Also, because the user is wiping the coating or fluid on instead of standard painting methods, semi-paste paints or relatively highly viscous fluids can be used, not dissimilar to car waxes or paste shoe polish. This causes a much better protective film to be applied than by any other standard method of applying paints. The vehicle does not evaporate through the surface dried film making pin holes in it.

Now that even semi-paste coatings can be custom tinted at the store by using low frequency sound that doesn't overheat the products and thoroughly mixes them no matter the shape of the container they are in, it is possible to make a cartridge painter as it was a cartridge for computer printers. There will be almost no mess, no fuss and a much improved flat finish vs. orange-peel from a roller that is full of pinholes and craters under a microscope. The coverage is almost always, if not always, one coat because the fabric or spreading material is relatively wide (three inches wide) and is all on the surface sliding the paint on. In contrast, a standard bristle brush has possibly one-half inch of bristles sliding and unloading paint onto the surface, so the present invention is offering at least six times the spreading and unloading capacity with the same stroke, depending on the width of the spreading material. One stroke is all that is needed. It is the fastest way to paint. This extra energy supplied also breaks the surface tension of any laitance (a deposit) left on the surface so the paint bonds better. The surface is slightly charged by this action with the present apparatus.

Each end of the housing (in which the cartridge is placed) is pointed with a ninety degree angle. One of the ends or angle ends makes a perfect edge tool. This pointed end includes two relatively narrow faces, with the faces running at a ninety degree angle. The faces do not catch the woodwork or ceiling texture because the faces have no square corners. Small wheels are not needed. The polyethylene ends or faces of the present tool has plenty of slick plastic to slide without marking or ruining anything. The end for edging does not fill up like a roller edger because the coating is coming from within, not dipping. Also, the present tool includes fabric or spreading material angled inwardly seven degrees so that if there is a trail from the edger, it does not touch the woodwork or ceiling. Only a couple of the fabrics or spreading materials used with the present invention leave even the slightest trail. The vast majority of the spreading materials in use with the present invention leave no trail. By nature, rollers usually do, especially short napped covers which are the ones used on edgers.

The other end of the housing, in which the cartridge is placed, is also pointed at a ninety degree angle to get right in the corners. This pointed end includes two relatively wide faces, with the faces running at a ninety degree angle. The fabric or spreading material is rolled up onto each of the faces of the pointed end to enable the user to paint a small area or to paint the adjacent wall at the corner of the room.

The present tool includes woven polyester fabric or spreading material with openings as small as seven microns to control the flow of even alcohol stains and as large as 100 microns for textures. This fabric or spreading material is sonically welded to the backing of the brush fabric which is also polyester. Then to the woven fabric is sonically welded a narrower piece of reticulated foam to act as a secondary reservoir. It also acts as a spring to keep the hard plastic manifold out from the wall a bit so the material can flow out. Otherwise, the wall would act like a cap and close the outlet holes in the manifold. Then on the opposite side of the manifold from the fabric, the present invention includes a circular rim of urethane gasket material which tightens to the main reservoir or housing when slid into the slot provided on the housing and is locked in place to the housing. The brush fabric or spreading material may have openings, such as one-eighth inch to one-fourth inch openings, in the backing that are in the exact location as the apertures in the hard plastic manifold to allow the coating material to wick its way to the wall or substratum. Once the fabric or spreading material is saturated with paint, most of the drag is lessened.

Inside the chamber or housing, the present invention may include a double membrane urethane bag that looks like two long hot dogs running along the sides with an overhead saddle or channel where the air is pumped in or let out. A certain amount of air is let out when the outlet valve is opened and then a piece of three PPI reticulated coated foam which was compressed springs back to push all of the air in the bags out. This leaves the chamber ready to be re-filled. When finished, simply slide the bottom off and everything is open and easily cleaned.

The handle on the housing is low profile to keep the user's hand as close to the surface being painted to cut down on the feeling of drag and tipping. Each side of the handle has a rectangular spring loaded piston or pump that slides in and out. At the front end of the handle face is a one way membrane valve letting the air in and then there is a one way membrane valve at the bottom of the handle to let the air into the bags. At the back of the handle is a twist open valve to let the air out before refilling or cleaning. On the top at one end is the fill port which screws on to prevent leakage. It has a three-eighth inch plug which can be replaced with a Colder Plastic® one way quick connect for refilling from a backpack such as a four gallon backpack. This works especially well for outside siding. The user has both hands to hold the ladder when ascending and descending. Lap marks are pretty well eliminated because it is so fast and you get one four gallon color batch by filling the backpack. This usually will cover one whole side of a house so the color is the same.

The kit contains a pouring spout, a tray to set it in when not in use and a pencil point brush for very small areas.

It should be noted that the pistons of the pump may be operated by mechanical fingers where the apparatus is mounted at the end of long arm extension pole. A two story house can be painted without a ladder.

It should be noted that the pump may include a ratchet for greater power such that the pistons are compressed and ratcheted at the same time.

It should be noted that the present invention may be used with a backpack that includes a quick connect to refill the cartridge, where a relatively great amount of fluid is in a receptacle in the backpack and a tube extends from the backpack to the front of the person wearing the backpack, and where the tube includes the quick connect for refilling the cartridge.

What is claimed is:

1. A hand held wiper for wiping a fluid on a substrate, comprising:

a) a housing;

b) a manifold on the housing, wherein the manifold includes multiple fluid passages to control fluid flow;

c) spreading material on the manifold such that the manifold provides a base for the spreading material, with the spreading material comprising a fiber network, with a bottom of the spreading material having an arcuate surface extending in a lateral direction to minimize drag as the hand held wiper is wiped side to side across the substrate;

d) a cartridge in the housing, wherein the cartridge comprises a flexible bag;

e) a fluid in the flexible bag;

f) a pump on the housing and transferring fluid from the cartridge to the manifold such that the fluid is wiped by the spreading material upon the substrate; and g) wherein the manifold includes two ends and a floor, with one of the ends of the manifold being designated a first end, with the first end having two faces extending at generally right angles relative to each other and at generally a right angle relative to the floor of the manifold, with the hand held wiper further comprising spreading material engaged at least partially on said faces of the first end, whereby said first end is a corner sperader end.

2. The hand held wiper of claim 1 and further comprising a main conduit between the cartridge and the manifold.

3. The hand held wiper of claim 2 and further comprising first and second one way check valves between the fluid in the cartridge and the manifold.

4. The hand held wiper of claim 3, wherein the hand held wiper includes a resilient section, wherein the resilient section is disposed between the first and second one way check valves such that fluid is pushed from said resilient section of the main conduit and through the second one way check valve and to the manifold portion and wherein, upon a release of an action upon said resilient section, the resilient section expands to draw fluid from the cartridge and through the first one way check valve.

5. The hand held wiper of claim 1, wherein the manifold includes two ends, with one of the ends of the manifold being designated a second end, with the second end having two faces extending at generally right angles relative to each other and at generally a right angle relative to the floor of the manifold, with the spreading material terminating immediately at floor portions leading immediately into said faces of the second end, and with said two faces of the second end being free of said spreading material, whereby said second end is an edger end.

6. The hand held wiper of claim 1, wherein the cartridge is removable from the housing.

7. The hand held wiper of claim 1, wherein a valve is on the cartridge such that, whether the cartridge is on or off the housing, air is kept out of the fluid in the cartridge.

8. The hand held wiper of claim 1, wherein the manifold is removable from the housing.

9. The hand held wiper of claim 1, wherein the manifold is slideably engagable to the housing.

10. The hand held wiper of claim 1, wherein the spreading material is selected from the group of spreading materials consisting of woven spreading materials, polyester spreading materials, lint free and woven polyester spreading materials, knitted polyester spreading materials, wool spreading materials, knitted polyester and wool spreading materials, reticulated foam spreading materials, brush bristle spreading materials, polyester brush bristle spreading materials, polyester and pure china bristle blend spreading materials, and plastic prong bristle special effect spreading materials.

11. The hand held wiper of claim 1, wherein the spreading material is engaged to the manifold.

12. The hand held wiper of claim 1, wherein the manifold includes a rectangular portion and two generally triangular portions, with the triangular portions being opposite of each other, with each of the triangular portions being set at opposite ends of the rectangular portion, such that one of the triangular portions forms a support for a corner spreader end and such that the other of the triangular portions forms a support for an edger end.

* * * * *